US008500521B2

(12) United States Patent
Boeck et al.

(10) Patent No.: US 8,500,521 B2
(45) Date of Patent: Aug. 6, 2013

(54) HAND-HELD POWER TOOL

(75) Inventors: Cornelius Boeck, Kirchheim (DE); Joachim Schadow, Stuttgart (DE); Sinisa Andrasic, Schoenaich (DE); Josef Enfellner, Leinfelden-Echterdingen (DE); Michael Habele, Waldenbuch (DE)

(73) Assignee: Robert Bosch GmbH, Stuttgart (DE)

( * ) Notice: Subject to any disclaimer, the term of this patent is extended or adjusted under 35 U.S.C. 154(b) by 485 days.

(21) Appl. No.: 12/745,060

(22) PCT Filed: Sep. 29, 2008

(86) PCT No.: PCT/EP2008/062994

§ 371 (c)(1),
(2), (4) Date: May 27, 2010

(87) PCT Pub. No.: WO2009/068341

PCT Pub. Date: Jun. 4, 2009

(65) Prior Publication Data

US 2010/0304648 A1 Dec. 2, 2010

(30) Foreign Application Priority Data

Nov. 27, 2007 (DE) ..... 10 2007 057 032

(51) Int. Cl.
*B24B 55/05* (2006.01)

(52) U.S. Cl.
USPC ..... 451/451; 451/452; 451/455; 451/359

(58) Field of Classification Search
USPC ..... 451/451, 452, 454, 455, 457, 358, 451/359
See application file for complete search history.

(56) References Cited

U.S. PATENT DOCUMENTS

| | | | | |
|---|---|---|---|---|
| 4,059,930 | A | 11/1977 | Alessio | |
| 4,924,635 | A * | 5/1990 | Rudolf et al. | 451/344 |
| 5,005,321 | A * | 4/1991 | Barth et al. | 451/359 |
| 6,464,573 | B1 * | 10/2002 | Keller | 451/451 |
| 6,893,334 | B1 | 5/2005 | Stivers | |
| 7,014,547 | B2 * | 3/2006 | Kleider | 451/359 |
| 2004/0157540 | A1 | 8/2004 | Wendt et al. | |
| 2004/0157541 | A1 | 8/2004 | Wendt et al. | |
| 2006/0286910 | A1 * | 12/2006 | Voigt et al. | 451/359 |

FOREIGN PATENT DOCUMENTS

| | | | |
|---|---|---|---|
| CN | 1867425 | A | 11/2006 |
| DE | 3913898 | A1 | 10/1990 |
| DE | 10131266 | A1 | 1/2003 |
| EP | 0978353 | A1 | 2/2000 |

* cited by examiner

*Primary Examiner* — Dung Van Nguyen
(74) *Attorney, Agent, or Firm* — Maginot, Moore & Beck

(57) ABSTRACT

The invention relates to a hand-held power tool, particularly an angle grinder having a housing that has a flange neck, having a protective device that can be accommodated on the flange neck and that can be pivoted in the circumferential direction, and having at least one device for blocking at least one pivoting direction of the protective device. The invention proposes that the device for locking includes at least one stop and at least one counter-stop interacting with the stop.

31 Claims, 17 Drawing Sheets

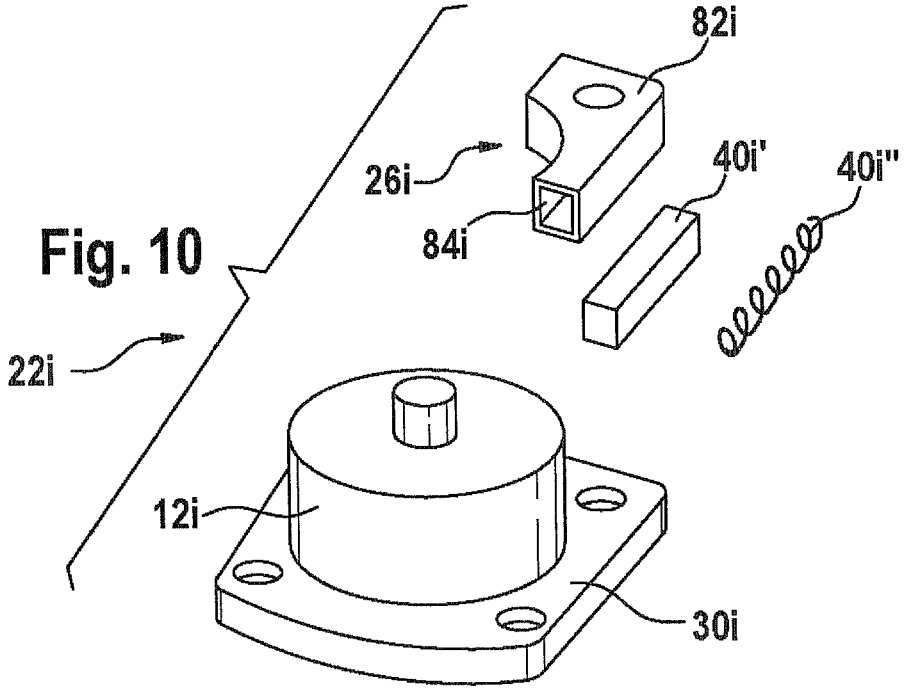
Fig. 10
Fig. 11
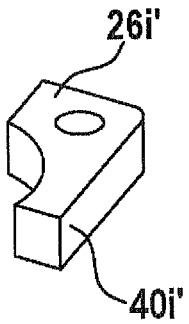
Fig. 12
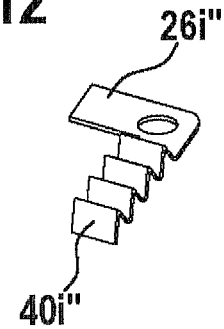

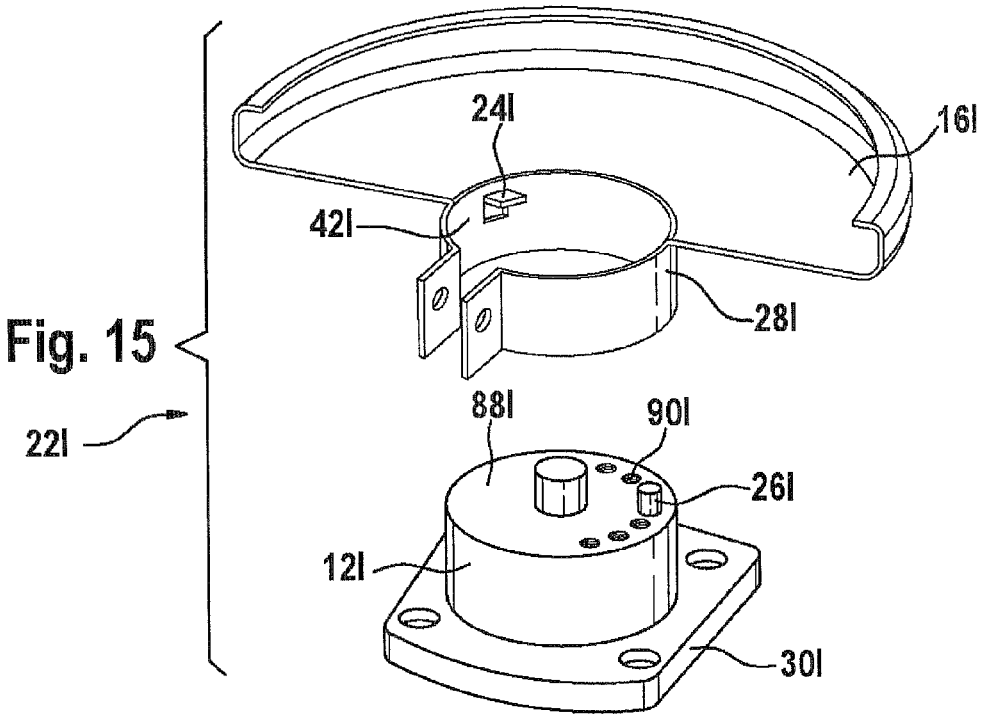
Fig. 15
Fig. 16
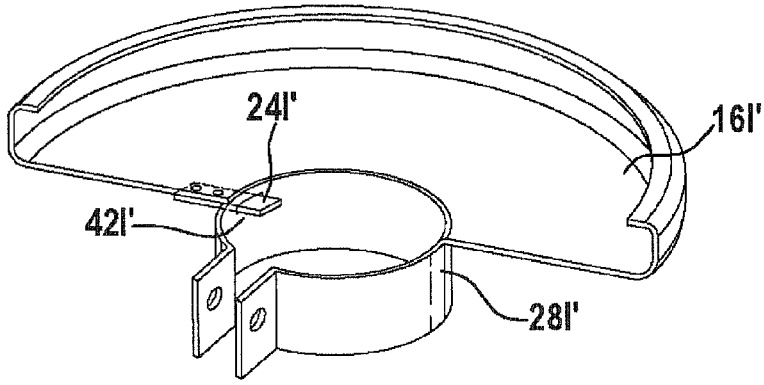

HAND-HELD POWER TOOL

CROSS-REFERENCE TO RELATED APPLICATION

This application is a 35 USC 371 application of PCT/EP2008/062994 filed on Sep. 29, 2008.

BACKGROUND OF THE INVENTION

1. Field of the Invention

The invention is based on a hand-held power tool.

2. Description of the Prior Art

DE 103 43 060 A1 has already disclosed a hand-held power tool that is embodied in the form of an angle grinder. The angle grinder has a housing with an output shaft extending out from the housing and a flange that is situated on the housing and forms a flange neck. A protective device is accommodated on the flange neck and can be rotated in the circumference direction. In order to lock the protective device to prevent it from rotating in its rotation directions, a detent lever is provided, which in its neutral position, produces a form-locked engagement with the protective device.

ADVANTAGES AND SUMMARY OF THE INVENTION

The invention is based on a hand-held power tool, in particular an angle grinder, having a housing equipped with a flange neck, having a protective device that can be accommodated on the flange neck and can be rotated in the circumference direction, and having at least one locking device for preventing the protective device from rotating in at least one rotation direction.

According to one proposal, the locking device includes at least one stop and at least one counterpart stop that cooperates with the stop. The protective device should protect the user of the hand-held power tool from injury in the event of a possible bursting of the grinding wheel, a so-called "burst-wheel incident". Usually, a broken grinding wheel sets the protective device into rotation. In an emergency situation or burst-wheel incident, the device according to the invention makes it possible to prevent the protective device from rotating or to stop it at a defined position in an energy-reducing fashion. The stops represent the last possible and desired rotation position of the protective device. The embodiment of the hand-held power tool according to the invention permits the manufacture of a simple and inexpensive locking device. An additional, separate locking device is not required since the components necessary for locking the protective device are to be provided on parts of the hand-held power tool.

The stops are advantageously embodied in such a way that in emergency operation, the protective device is only permitted to rotate in at least one rotation direction until it reaches a predetermined rotation position. In emergency operation, the device initially permits the protective device to rotate in relation to the housing until the stop and the counterpart stop come into contact with each other. In this context, "normal operation" should be understood to be an operation of the hand-held power tool in which energy from parts coming into contact with the protective device acts on the protective device only up to a predetermined value. "Emergency operation" should be understood to be an operation of the hand-held power tool in which energy from parts coming into contact with the protective device acts on the protective device above the predetermined value. The protective device is preferably situated around a disk-shaped, rotating tool of a hand-held power tool such as an angle grinder so that during operation of the hand-held power tool, the protective device can advantageously decelerate sparks and/or material particles and/or fragments of a disk such as a grinding wheel, a cut-off wheel, etc. that has burst during operation—in particular such fragments that are rotating and/or are hurled outward with powerful kinetic force—or can reduce an energy, in particular a kinetic energy, of the particles. The locking device for preventing the protective device from rotating in at least one rotation direction is embodied so that the protective device absorbs energy when struck by tool fragments by initially executing a rotating motion or turning motion in relation to the housing of the hand-held power tool. The locking device produces a frictional engagement between the flange neck and the protective device by means of a press fit. The protective device is advantageously embodied so that when a burst of energy with a predeterminable value is introduced into the protective device, the protective device rotates in relation to the housing. As a result, during normal operation, i.e. with the occurrence of a burst of energy below the predetermined value, the protective device is rigidly coupled to the flange neck and housing and only executes a rotating motion in relation to the flange neck and housing in emergency operation, i.e. with the occurrence of a burst of energy above the predeterminable value. After the introduction of a burst of energy when the tool bursts, the static friction between the flange neck and the protective device is overcome and the two components can advantageously execute a relative motion in relation to each other over a particular angular range. As a result, a particular portion of the energy is absorbed and the speed of the fragments emerging from the protective device is reduced.

According to another proposal, the stops are embodied so that they prevent the protective device from rotating in one rotation direction and permit the protective device to rotate in the opposite rotation direction. As a result, only the rotation direction in which the protective device would rotate uncontrollably in emergency operation is advantageously prevented. The protective device is able to rotate or to click past the detent positions in the opposite direction.

According to another proposal, the stop is affixed to the protective device and the counterpart stop is affixed to the housing of the hand-held power tool. When the protective device is moved in relation to the rest of the hand-held power tool, the stop affixed to the protective device moves together with the protective device while the stop affixed to the housing remains stationary in relation to the hand-held power tool. In the text below, the stop affixed to the housing is also referred to as the "static" stop and the stop affixed to the protective device is also referred to as the "mobile" stop. These stops should advantageously halt the relative movement of the protective device in relation to the housing; the stops can be used as a so-called "burst-wheel safety device". The stops permit a relative movement of the protective device in relation to the housing of the hand-held power tool until the "static" stop on the housing and the "mobile" counterpart stop on the protective device come into contact with each other. A tool manufacturer thus has the possibility of placing the burst-wheel stops in a suitable position that is also safe for the user. This position can enable the greatest possible permissible rotation angle of the protective device while also preventing the user from being injured if the disk bursts. If a user himself is able to select the position of the burst-wheel stops, then the tool manufacturer can provide a coding of the permissible positions.

According to another proposal, the stop is provided on a clamping band of the protective device. This permits a simple, inexpensive manufacture that provides easy access to the stop. The arrangement of the stop on the clamping band of the protective device achieves an optimum cooperation with a counterpart stop situated on the housing. It is advantageously possible to achieve additional savings in terms of parts, space, assembly complexity, and costs if the stop is at least partially composed of a fastening element such as a clamping screw, a nut, a clamping lever, and/or other fastening elements deemed suitable by the person skilled in the art.

According to another proposal, the counterpart stop is provided on a transmission flange, on the flange neck, on a transmission housing, and/or on a housing element. It is thus advantageously possible for elements that are already present, such as screws for fastening the transmission flange to the transmission housing, to be additionally embodied as the counterpart stop and to be simultaneously used for this purpose. It is also conceivable for the counterpart stop to be integral to the transmission flange, the flange neck, the transmission housing, and/or the housing element. In addition, the device for locking, in particular for locking the counterpart stop of the protective device, is advantageously provided to be subsequently integrated into the transmission flange, the flange neck, the transmission housing, and/or the housing element of the hand-held power tool.

According to another proposal, the housing element is embodied as an element provided on or under the transmission flange or as an element that can be accommodated on the flange neck. This advantageously permits the housing stop to be placed in any conceivable position.

Advantageously, the stop is adjustably situated on the protective device and/or the counterpart stop is adjustably situated on the housing and/or the housing element. This makes it possible to place the burst-wheel stops in a suitable position that is also safe for the user. This position can enable the greatest possible permissible rotation angle of the protective device while preventing the user from being injured if the disk bursts. If a user himself is able to select the position of the burst-wheel stops, then the tool manufacturer can provide a coding of the permissible positions, for example by means of predetermined threaded holes for a screw-mountable stop bolt.

According to another proposal, the housing element is connected to the housing in an adjustable fashion. Advantageously, by means of the adjustable housing element on the housing, the counterpart stop is automatically also embodied as adjustable. The variation of the stop position can be controlled by selecting the position of the housing element on the housing, with no additional effort. According to another proposal, the housing element is connected to the housing by means of projections of the housing element and/or housing, which can be inserted into recesses of the housing and/or housing element. After the protective device is placed onto the flange neck and fastened to it, the housing element is affixed to the transmission flange. Integrating the fastening into the existing components makes it unnecessary to provide additional fastening elements, thus yielding a more reasonably priced manufacture of the hand-held power tool. It is also advantageously conceivable for this housing element to be embodied in the form of a retrofitting component.

According to another proposal, the locking device has at least one damping device. Usually, after the introduction of a burst of energy when the tool bursts, the static friction between the flange neck and the protective device is overcome and the two components can advantageously execute a relative motion in relation to each other over a particular angular range until the stops come into contact with each other. This absorbs a particular portion of the energy and reduces the speed of the fragments emerging from the protective device. The action of the damping device is now advantageously even more energy-absorbing.

According to another proposal, the counterpart stop and/or stop is equipped with the damping device and/or embodied as the damping device. As a result, through a suitable selection of the position and/or material and/or embodiment of the stop, an optimal damping action and thus energy absorption can be achieved. If a base body with a replaceable damping device is provided as the stop, then both the manufacturer and the customer can adapt the damping device to the intended use at any time.

According to another proposal, the stop is embodied in the form of at least one lug that engages in a groove embodied in the form of a counterpart stop. This embodiment permits a simple, inexpensive manufacture of the locking device since it requires nothing more than providing a groove and a lug in a component of the hand-held power tool.

According to another proposal, the delimitation of the groove is embodied in the form of an element inserted into the groove, a tab provided on the disk element, or a protuberance provided on the plate element. These embodiments make it possible to produce both a fixed and an adjustable counterpart stop on the housing.

According to another proposal, the counterpart stop affixed to the housing additionally serves as a hold-down element for the protective device. In this case, one component advantageously performs two functions.

According to the proposal in an advantageous modification of the invention, the locking device has at least one receiving element, which is situated on a transmission flange and is provided to accommodate the counterpart stop, making it possible to achieve a particularly advantageous, especially stable arrangement or accommodation of the counterpart stop on the transmission flange. The receiving element in this case is preferably designed to absorb forces—which are transmitted via the counterpart stop from a protective device that is moving in a rotation direction because a tool fragment of a bursting tool has struck the protective device—or more precisely stated, to support the counterpart stop in opposition to these forces in order to protect a user of the hand-held power tool.

According to another proposal, the receiving element has at least one recess on the transmission flange, which is provided to accommodate the counterpart stop, thus making it possible to implement a simply designed accommodation of the counterpart stop on the transmission flange. In a preferred embodiment, the recess is shaped to precisely fit against a shape of the counterpart stop, making it possible to achieve a particularly secure, play-free arrangement of the counterpart stop.

According to another proposal, the receiving element has at least one support element that supports the counterpart stop in at least one turning direction. A stable support of the counterpart stop, particularly in one turning direction of a tool, can be achieved when the stop comes into contact with the counterpart stop, thus at least partially preventing a damage to the counterpart stop. This can be achieved in a simply designed fashion if the support element is composed of a rib extending in the radial direction.

According to another proposal, the receiving element has at least one support element that supports the counterpart stop in at least one radial direction, thus making it possible to achieve an advantageous support of the counterpart stop toward the outside in the event of a bursting tool and additionally making it possible to absorb centrifugal forces, which occur in the radially outward direction in the event of an impact, in order to protect a user.

It is also possible to achieve additional savings in terms of parts, space, assembly complexity, and costs and it is also possible to achieve a particularly stable arrangement of the support element for supporting the counterpart stop in the radial direction and/or of the support element for supporting the counterpart stop in at least one rotation direction on the transmission flange if the support element for supporting the counterpart stop in the radial direction and/or the support element for supporting the counterpart stop in at least one rotation direction is/are embodied as integral to the transmission flange. In this context, "integral to" should in particular be understood to be of one piece with, manufactured from one cast, and/or embodied as one component.

An advantageous replacement of the counterpart stop on the transmission flange can be achieved if the counterpart stop is screw-mountably situated on a transmission flange. If a screw is provided for fastening the counterpart stop to the transmission flange preferably at the same time as the transmission flange is fastened to the hand-held power tool or more precisely stated, to its housing, then it is also possible to achieve a particularly compact arrangement and an especially stable fastening to the transmission flange. Essentially, it is also always conceivable for the counterpart stop to be already preinstalled on the transmission flange and to be installed as a unit together with the transmission flange and/or to be arranged on the transmission flange by means of an alternative fastener deemed suitable by the person skilled in the art and/or in a particularly advantageous fashion, to be embodied as integral to the transmission flange.

According to another proposal, the counterpart stop is composed of a material that is different from a material of a transmission flange, permitting properties of the counterpart stop to be advantageously adapted to an energy transmission or a force transmission to the counterpart stop when it is struck by the stop in the event of a bursting tool. The counterpart stop in this case can be composed of a material that already absorbs part of the energy transmitted to the counterpart stop and only transmits part of the energy to the transmission flange and/or the hand-held power tool.

According to another proposal, the counterpart stop has an indentation that is situated in an impact region for the stop, thus making it advantageously possible for a fastening element, in particular a nut, which is provided to be screw-mounted by means of a clamping screw, to be accommodated in the impact region and also making it possible to advantageously guide a clamping screw end past the counterpart stop.

BRIEF DESCRIPTION OF THE DRAWINGS

Other advantages ensue from the following description in conjunction with the drawings, in which:

FIG. 10 shows a ninth embodiment of a locking device in which a damping device is provided, FIG. 11 shows an alternative embodiment of the damping device according to FIG. 9, FIG. 12 shows another alternative embodiment of the damping device according to FIG. 9, FIG. 15 shows a twelfth embodiment of a locking device in which a counterpart stop is provided on an end surface of the flange neck, FIG. 16 shows an alternative embodiment of the counterpart stop according to FIG. 14.

DESCRIPTION OF THE PREFERRED EMBODIMENTS

Figure 1:
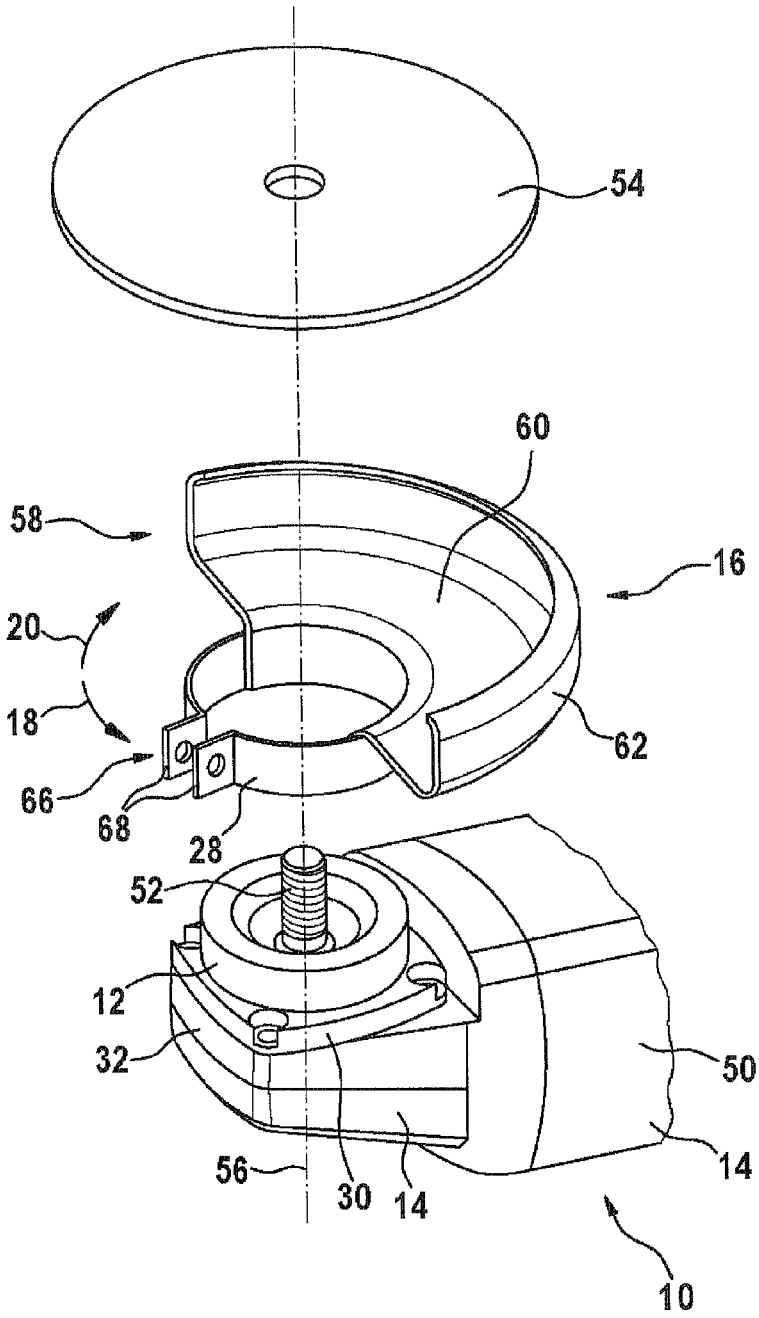
FIG. 1 is an exploded representation of a partially depicted hand-held power tool equipped with a protective device that can be rotated in the circumference direction.

FIG. 1 shows a partially depicted hand-held power tool. In the exemplary embodiments here, the hand-held power tool is an angle grinder 10. The angle grinder 10 has a housing 14 that includes a motor housing 50 and a transmission housing 32 flange-mounted to the motor housing 50. Protruding from the transmission housing 32 is an output shaft 52 whose free end supports a disk-shaped tool 54, for example a grinding disk, that can be driven in rotary fashion around an axis 56 of the output shaft 52.

The output shaft 52 is supported in rotary fashion in a bearing, which is not shown here and in the exemplary embodiments here, is accommodated in a transmission flange 30 constituted by the transmission housing 32. The transmission housing 32 includes a freely extending, cylindrical flange neck 12 that adjoins the transmission flange 30 and encompasses the output shaft 52. On its outer circumference, the flange neck 12 accommodates a protective device 16, embodied in the form of a wheel guard, which is able to rotate in the circumference direction 18, 20 on the flange neck 12. The protective device 16 includes a base body 58 and a receiving collar 28 that is connected to the base body 58 and forms a central opening to permit the output shaft 52 to pass through unimpeded. The receiving collar 28 is embodied in the form of a cylindrical body that extends parallel to the flange neck 12. The base body 58 is provided to protect a user of the hand-held power tool from sparks and/or material particles produced during operation of the hand-held power tool. To this end, the base body 58 is composed of a disk-shaped element 60 that is semicircular in shape; the disk-shaped element 60 covers an angular range of approx. 180° of the tool 54. As a result, a user of the hand-held power tool 10 equipped with the protective device 16 is protected in a particularly advantageous way from sparks, material particles, and/or fragments of a burst tool that are moving radially outward with high energy in that sparks and/or any material particles are conveyed toward the front, away from the user. The disk-shaped element 60 is adjoined by a protective edge 62 that initially extends perpendicular to the disk-shaped element 60 and then extends parallel to the disk-shaped element 60.

The protective device 16 in the following exemplary embodiments is fastened to the flange neck 12 by means of frictional engagement through a clamping of the receiving collar 28, which is embodied in the form of a clamping band, in a fashion similar to a pipe clamp; it is also conceivable to fasten the protective device 16 to the flange neck 12 in any other way deemed suitable by a person skilled in the art. For example, the clamping band can also be embodied in the form of a separate part that is placed around the receiving collar of the protective device 16. The clamping band 28 is clamped in the conventional way either by means of a clamping screw 64 or by means of a clamping lever. For this purpose, the hand-held power tool 10 includes the clamping band 28 and a clamping device 66. The clamping band 28 is embodied in an annular form and is preferably welded onto the base body 58. Essentially, it is also conceivable for the clamping band 28 and the base body 58 to be connected to each other by means of any other connection deemed suitable by the person skilled in the art. The annular clamping band 28 is clamped around the flange neck 12 with the aid of the clamping device 66; the clamping device 66 accomplishes this by constricting or expanding a circumference of the annular clamping band 28. In the clamping device 66 shown in the exemplary embodiment, two ends 68 of the clamping band 28 are clamped against each other by the clamping screw 64.

In emergency operation, for example in the event of a bursting of the tool 54, a so called burst-wheel incident, the fragments produced are hurled with high kinetic energy toward the annular inner region of the protective device 16. The kinetic energy of the impact generates a force acting in a tangential direction, which tends to cause the protective device 16—despite the its being clamped to the flange neck 12—to rotate out of its position in the radial direction, i.e. in the circumference direction 18, 20. The rotation of the protective device 16 in relation to the flange neck 12 and housing 14 by an angular amount that can be experimentally determined in advance absorbs a part of the kinetic energy of the fragments. The fragments of the burst disk-shaped tool 54 are decelerated and exit from an open region of the protective device 16 at a reduced speed.

In order to prevent the protective device 16 from rotating in the event of a burst-wheel incident or in order to stop it at a definite position in an energy-reducing fashion, the hand-held power tool 10 has a locking device 22 for preventing the protective device 16 from rotating in at least one rotation direction 18, 20. According to FIGS. 2 through 30*b*, the device 22 according to the invention includes at least one stop 24 and at least one counterpart stop 26 that cooperates with the stop 24; the stop 24 is affixed to the protective device and the counterpart stop 26 is affixed to the housing of the hand-held power tool 10. The rotation of the protective device 16 is to be stopped by means of the stop 24 affixed to the protective device, which strikes against the counterpart stop 26 affixed to the housing.

The at least one stop 24 and the at least one counterpart stop 26 according to FIGS. 2 through 30*b* are advantageously embodied so that in emergency operation of the hand-held power tool 10, a rotation of the protective device 16 in at least one rotation direction 18, 20 is enabled only until a predetermined rotation position is reached.

Preferably, the stops 24, 26 are embodied so that they prevent the protective device 16 from rotating in one rotation direction 18 or 20 and permit the protective device 16 to rotate in the opposite rotation direction 20 or 18.

In the exemplary embodiments shown here, the stop 24 is provided on the clamping band 28 of the protective device 16; it is also possible for the stop 24 affixed to the protective device to be arranged in any other way deemed suitable by a person skilled in the art. In this regard, the exemplary embodiments show different variants of the arrangement of the stop 24 on the clamping band 28, such as: an arrangement on an outside 72 of the clamping band 28, an arrangement on an inside 42 of the clamping band 28, an arrangement on an end surface 44 of the clamping band 28, or another variant in which the stop 24 is embodied as integral to or of one piece with the protective device 16 in that the two ends 68 of the clamping band 28 serve as stops 24. There are still other conceivable arrangements of the stop 24 on the clamping band 28 that may be deemed suitable by the person skilled in the art. The stop 24 can be embodied either as a separate part fastened to the clamping band 28 or as integral to the protective device 16.

The counterpart stop 26 affixed to the housing is fastened to different parts in the exemplary embodiments shown here according to FIGS. 2 through 30*b*. For example, the counterpart stop 26 is provided on the transmission flange 30, on the flange neck 12, on the transmission housing 32, and/or on a separate housing element 34 that is affixed to the housing of the hand-held power tool 10. The counterpart stop 26 can be embodied either as a separate element fastened to the respective part 12, 30, 32, 34 or as integral to the respective part 12, 30, 32, 34.

In the exemplary embodiments, the separate housing element 34 affixed to the housing is embodied as a plate element 34 provided on or under the transmission flange 30 or as a ring element that can be accommodated on the flange neck 12.

Advantageously, the stop 24 can be adjustably situated on the protective device 16 and/or the counterpart stop 26 can be adjustably situated on the housing 14 and/or the housing element 34. In addition, the housing element 34 can be adjustably connected to the housing 14. The housing element 34 can be connected to the housing 14 by means of projections 36 that are provided on the housing element 34 and/or housing 14 and can be inserted into recesses 38 of the housing 14 and/or housing element 34.

Figure 2:
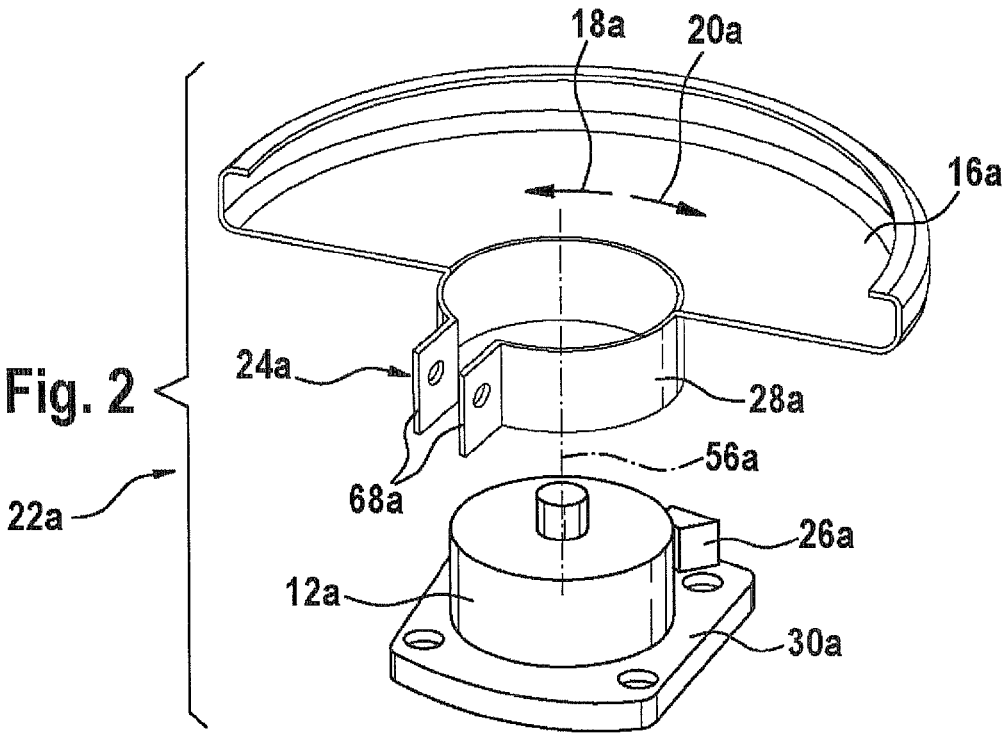
FIG. 2 shows a first embodiment of a device according to the invention for locking at least one rotation direction of the protective device, in which the device is equipped with a stop and a counterpart stop.

The twenty exemplary embodiments of the locking device 22 according to the invention, which are shown in perspective, disassembled depictions in FIGS. 2 through 30*b*, are described in detail below:

FIG. 2 shows a first embodiment of a locking device 22*a* for preventing the protective device 16*a* from rotating in at least one rotation direction 18*a*, 20*a*. In this instance, a counterpart stop 26*a* is provided on the transmission flange 30*a*. The counterpart stop 26*a* is integral to the transmission flange 30*a*; the transmission flange 30*a* is preferably manufactured using a casting technique. The corresponding stop 24*a* on the protective device 16*a* constitutes the "burst-wheel stop" when the two stops strike against each other. In the present exemplary embodiment, an end 68*a* of the clamping band 28*a* is provided as a stop 24*a*. In this variant and in all of the others, the stop 24*a* does not absolutely have to be positioned at an end 68*a* of the clamping band 28*a*; it is instead also possible to select another suitable position.

Figure 3:
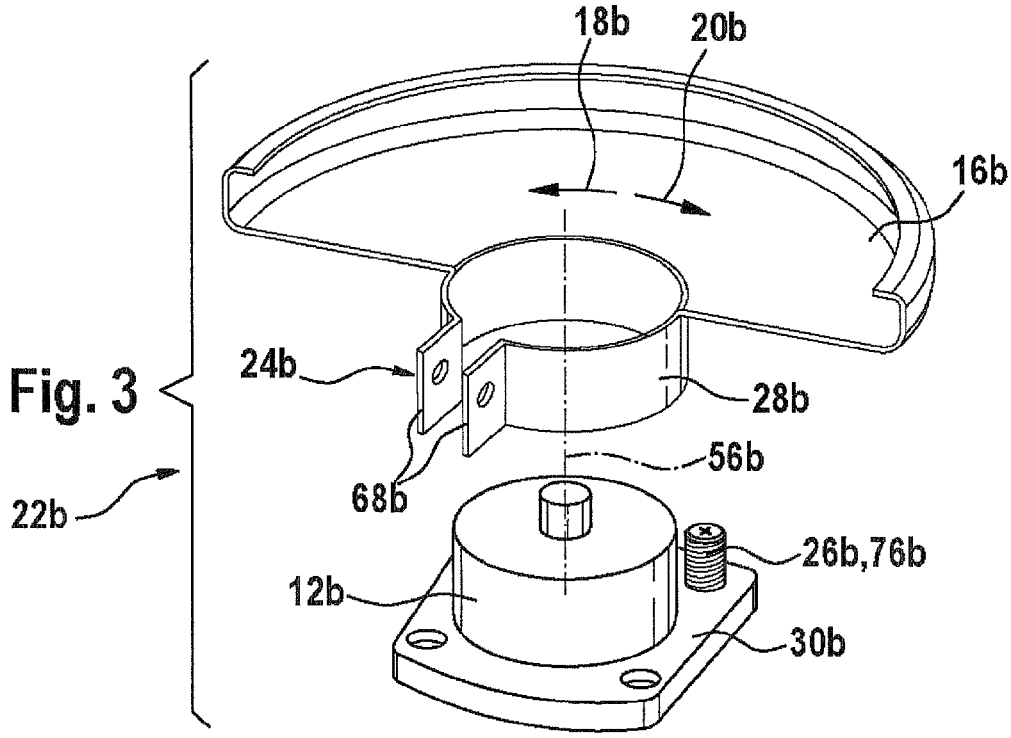
FIG. 3 shows a second embodiment of a locking device in which a fastening screw serves as a counterpart stop.

FIG. 3 shows a second embodiment of a locking device 22*b*. Usually, the transmission flange 30*b* is fastened to the transmission housing 32*b* by means of screws 76*b*. In the second exemplary embodiment, at least one of these screws 76*b* is used as a counterpart stop 26*b*; this counterpart stop 26*b* is embodied as "static" in relation to the "rotating" protective device 16*b*. As a result, one transmission flange fastening screw 76*b* is embodied in the form of an elongated, stationery bolt serving as a rotation end stop 26*b* that obstructs the ability of the protective device 16*b* to rotate. In the event of a burst-wheel incident, the counterpart stop 26*b* collides with the stop 24*b* situated on the protective device 16*b*.

Figure 4:
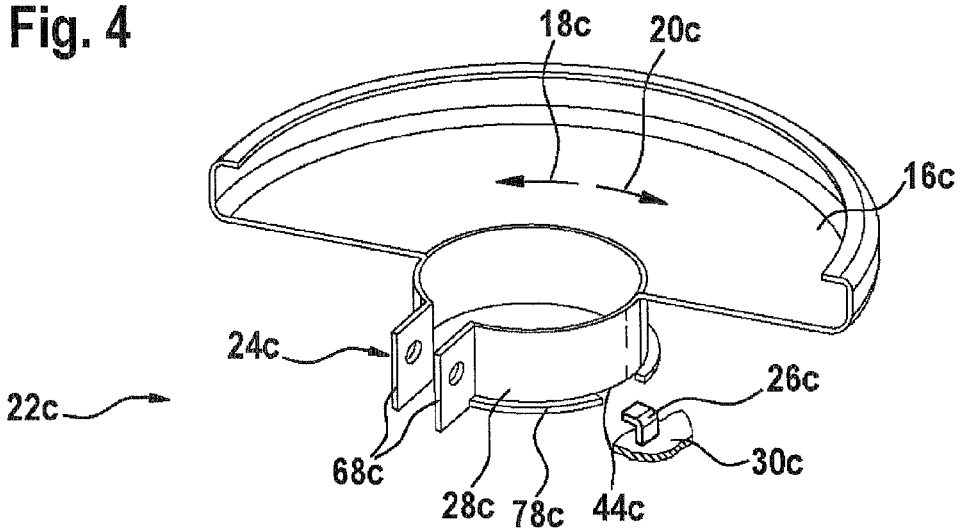
FIG. 4 shows a third embodiment of a locking device in which the counterpart stop affixed to the housing additionally serves as a hold-down element for the protective device.

FIG. 4 shows a third embodiment of a locking device 22*c*. In this instance, a counterpart stop 26*c* in the form of a hook is provided on the transmission flange 30*c*, which is only partially depicted here, and cooperates with a stop 24*c* on the clamping band 28*c* of the protective device 16*c*; the stop 24*c* is composed of the two ends 68*c* of the clamping band 28*c*. In addition, at an end surface 44*c* oriented toward the transmission flange 30*c*, the clamping band 28*c* has a flanged edge or more precisely stated, an edge 78*c* that extends perpendicular to the clamping band 28*c* over at least part of the circumference of the clamping band 28*c* and is hooked by the counterpart stop 26*c* embodied in the form of a hook. By means of this, the counterpart stop 26*c* affixed to the housing additionally serves as a hold-down element for the protective device 16*c* by holding the protective device 16*c* in the axial operating position by means of a form-locked connection.

Figure 5:
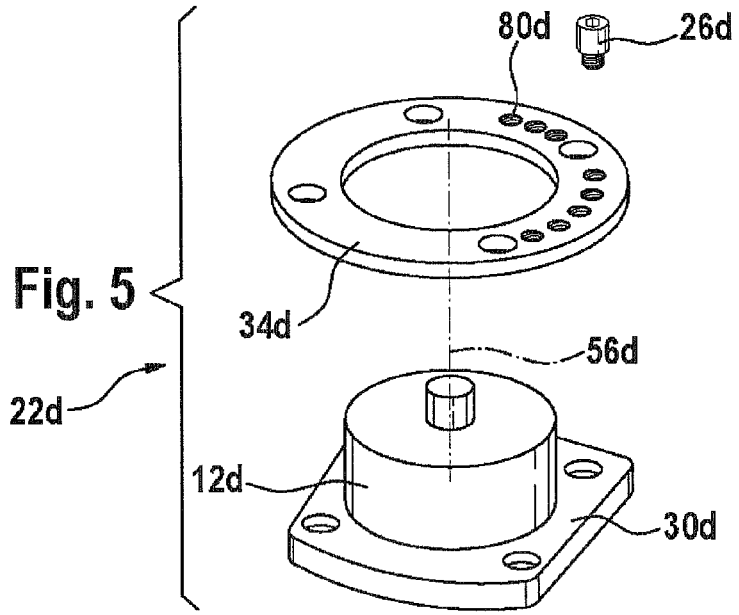
FIG. 5 shows a fourth embodiment of a locking device in which the counterpart stop is provided on a housing element embodied in the form of a plate element.

FIG. 5 shows part of a fourth embodiment of a locking device 22*d*. In this a variant, a housing element 34*d* embodied in the form of an annular plate element is screw-mounted to the transmission flange 30*d*; it would also be conceivable to use any other suitable type of fastener. In this plate element 34*d*, a plurality of threaded holes 80*d* situated concentric to an axis 56*d* of the output shaft are provided, in which a counterpart stop 26*d* embodied in the form of a threaded bolt can be mounted; the counterpart stop 26*d* can also be fastened to the housing element 34*d* in a different way. The different threaded holes positions permit the user to select a suitable burst-wheel stop position. It is thus possible, in the event of a burst-wheel incident, for the counterpart stop—which is affixed to the protective device and is not shown here—to be stopped at positions that are desired by the manufacturer or user. Alternatively to the annular plate element 34*d*, the housing element can also be embodied in the form of an annular segment 34*e* according to FIG. 6.

Figure 6:
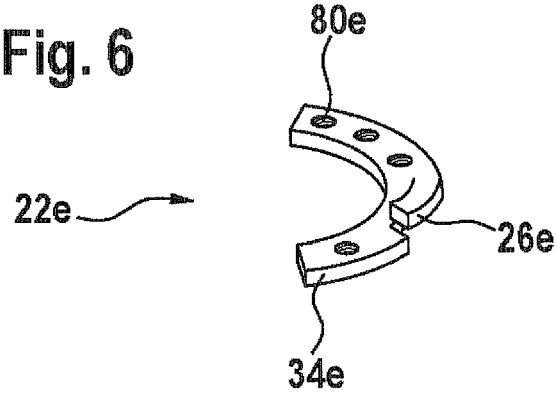
FIG. 6 shows a fifth embodiment of a locking device in which the counterpart stop is provided as a catch hook on a housing element embodied in the form of a shaped sheet metal part.

FIG. 6 shows part of a fifth embodiment of a locking device 22*e*. In this variant, a catch hook 26*e* is punched out from the annular segment 34*e* embodied in the form of a shaped sheet metal part. After it is bent into position, this catch functions as a counterpart stop 26*e* for the protective device. The variation of the position of the counterpart stop 26*e* can be controlled through the selection of the screw-mounting position of the annular segment 34*e*. For this purpose, a plurality of threaded holes 80*e* are provided in the annular segment 34*e*, situated concentric to an axis of the output shaft. Alternative to this, in lieu of the annular segment 34*e*, it is also possible for an annular plate element with a catch hook to be provided.

Figure 7:
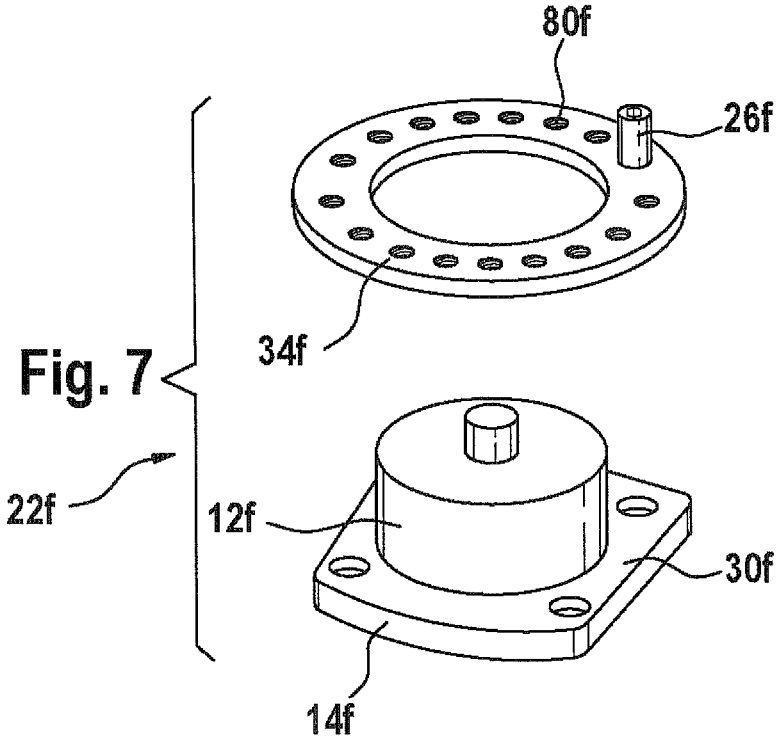
FIG. 7 shows a sixth embodiment of a locking device in which a housing element is attached to a housing of the hand-held power tool in an adjustable fashion.

FIG. 7 shows part of a sixth embodiment of a locking device 22*f*. In this variant, a counterpart stop 26*f* is provided, which is permanently affixed to the annular plate element 34*f*. The annular plate element 34*f* has a plurality of screw holes 80*f* situated around the circumference. By means of these screw holes 80*f*, the housing element 34*f* can be adjustably fastened to the housing 14*f* or transmission flange 30*f*. It is thus possible to influence the position of the counterpart stop 26*f* affixed to the housing. In this connection, it is also possible to embody another variation, not shown here, of the screw holes by embodying them as oblong holes, thus making it possible to carry out an adjustment by simply loosening the screws.

Figure 8:
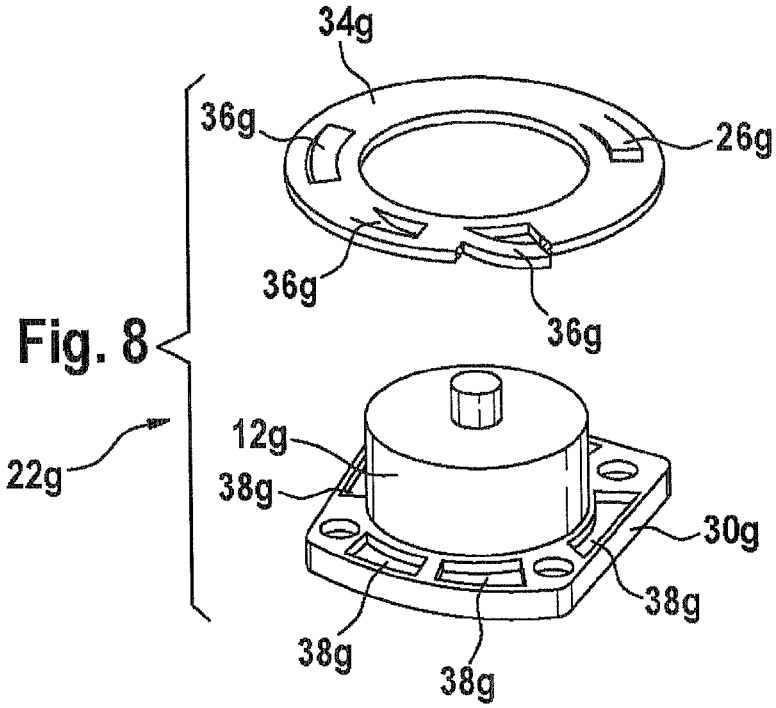
FIG. 8 shows a seventh embodiment of a locking device in which an insert piece equipped with a counterpart stop has projections that can be inserted into recesses in the transmission flange.

FIG. 8 shows part of a seventh embodiment of a locking device 22*g*. In this variant, a housing element 34*g* embodied in the form of an annular insert piece is placed onto the transmission flange 30*g*. This insert piece 34*g* is equipped with projections 36*g* that rest in corresponding recesses 38*g* in the transmission flange 30*g* and constrain a position-fixing of the insert piece 34*g* on the transmission flange 30*g*. A depicted hook or a permanently affixed bolt of the insert piece 34*g* constitutes a counterpart stop 26*g* in relation to the rotating protective device. Both the projections 36*g* and the hook 26*g* of the insert piece 34*g* can be embodied in the form of catches. In addition, the counterpart stop 26*g* can be adjustably mounted on the insert piece 34*g*.

Figure 9:
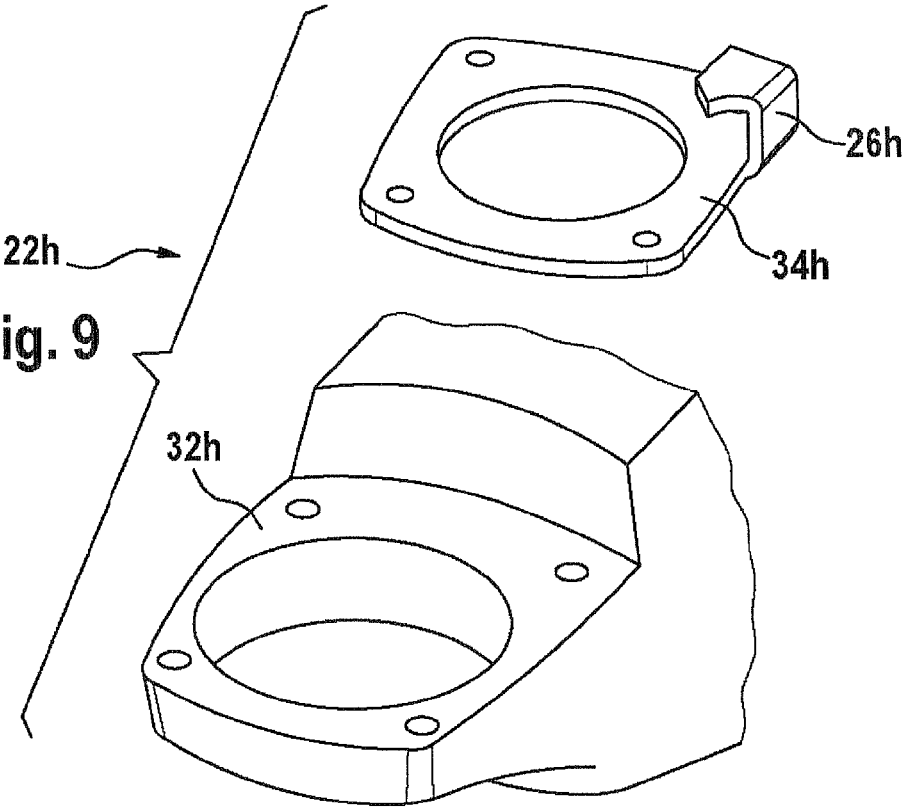
FIG. 9 shows an eighth embodiment of a locking device in which an insert piece equipped with a counterpart stop is situated under the transmission flange.

FIG. 9 shows part of an eighth embodiment of a locking device 22*h*. In this variant, a housing element 34*h* embodied in the form of an insert piece is situated under the transmission flange, not shown, and on the transmission housing 32*h*, i.e. between the transmission flange and the transmission housing 32*h*; the insert piece 34*h* has a counterpart stop 26*h* that protrudes upward and is embodied in the form of a hook. By means of a stop, which is not shown here and is provided in the protective device, this hook 26*h* produces the impact or collision situation.

The locking device 22 can preferably have at least one damping device 40; the counterpart stop 26 and/or the stop 24 is equipped with the damping device 40 and/or embodied as the damping device 40.

FIG. 10 shows part of a ninth embodiment of a locking device 22*i*. In this variant, a counterpart stop 26*i* is provided, which is placed onto, preferably screw-mounted to, the transmission flange 30*i* and has a stop base body 82*i* that is open at an end surface and has a recess 84*i* for accommodating the damping device 40*i*. The base body 82*i* of the counterpart stop 26*i* is equipped with the damping device 40*i*, e.g. a rubber pad 40*i*' or coil spring 40*i*", to be integrated into the recess 84*i*. The manufacturer or customer can insert different "dampers" as needed into the recess 84*i* of the stop base body 82*i*. In a burst-wheel movement, the counterpart stop of the protective device, not shown here, strikes against the inserted damping device 40*i* and is decelerated by it in an energy-absorbing fashion. FIGS. 11 and 12 show two other alternatives of the counterpart stop 26*i*, 26*i*". In FIG. 11, the counterpart stop 26*i* itself is embodied as a damping device 40*i* in that the preferably integral counterpart stop 26*i*' is embodied as plastically or elastically deformable; a potential deformation in this case can occur in a permanent or impermanent fashion. A permanent deformation would basically have the advantage that the tool manufacturer would be able to detect a burst-wheel incident. In FIG. 12, the counterpart stop 26*i*" itself is likewise embodied as a damping device 40*i*", and in fact, as a plastically deformable sheet metal element.

Figure 13:
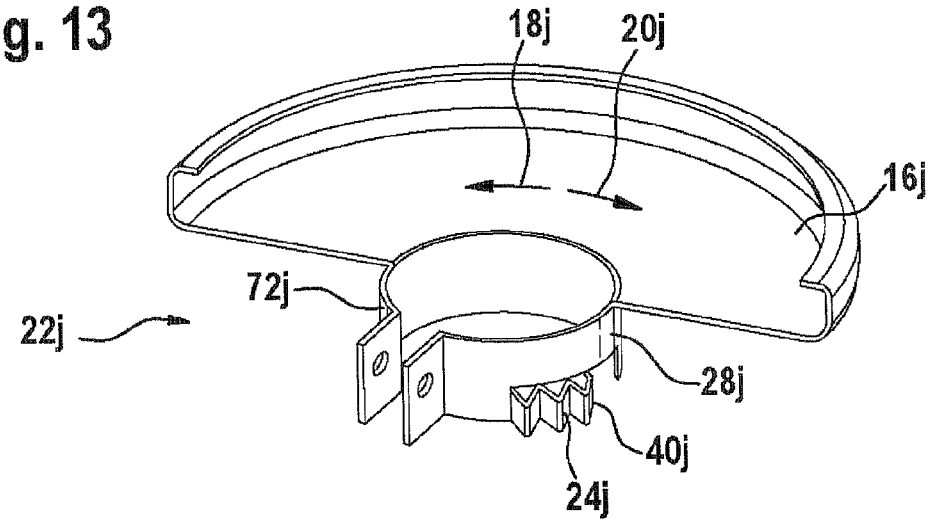
FIG. 13 shows a tenth embodiment of a locking device in which a stop situated on the clamping band is embodied in the form of a damping device.

FIG. 13 shows part of a tenth embodiment of a locking device 22*j*. In this variant, a stop 24*j* is provided, which is formed onto the clamping band 28*j* and consequently integrated into the protective device 16*j* and is embodied in the form of a damping device 40*j*. It would also be conceivable to provide a non-integral and therefore mounted stop with a damping device. The stop 24*j* constituting the damping device 40*j* is a folded element that reduces the kinetic energy in a burst-wheel incident through the permanent or resilient deformation of the folded element. Here, too, it should be noted that a permanent deformation has the advantage of making it possible to detect a burst-wheel incident.

FIGS. 14 through 17 show locking devices 22 in which the counterpart stop 26 is provided on the flange neck 12.

Figure 14:
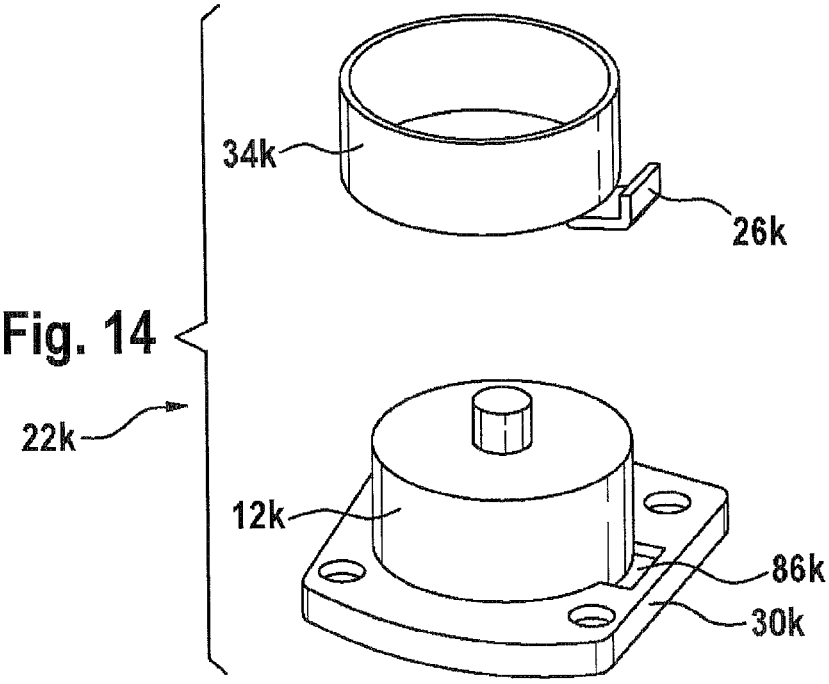
FIG. 14 shows an eleventh embodiment of a locking device in which a ring element equipped with a counterpart stop can be slid onto the flange neck.

FIG. 14 shows part of an eleventh embodiment of a locking device 22*k*. In this variant, the counterpart stop 26*k* affixed to the housing is provided on a housing element 34*k* that is attached to the flange neck 12*k*. The housing element 34*k* is embodied in the form of a ring element that can be accommodated on the flange neck 12*k*. The ring element 34*k*, which is slid onto the flange neck 12, is provided with a counterpart stop 26*k* embodied in the form of a hook, which is secured in form-locked fashion in a recess 86*k* of the transmission flange 30*k*. It would also be conceivable, however, to provide a denticulation to achieve the fixing between the transmission flange and the ring element. In a burst-wheel incident, the stop of the protective device, not shown here, strikes against the stop hook 26*k*.

Figure 17:
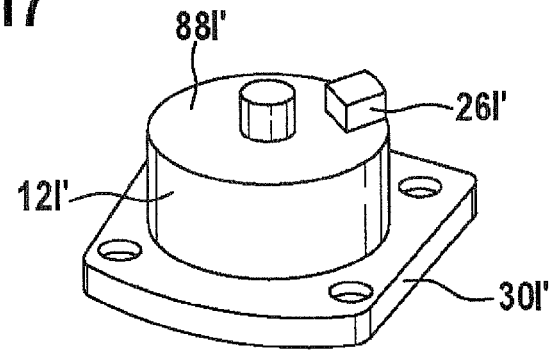
FIG. 17 shows another alternative embodiment of the counterpart stop according to FIG. 14.

FIG. 15 shows a twelfth embodiment of a locking device 22*l*. In this variant, the counterpart stop 26*l* is provided on an end surface 88*l* of the flange neck 12*l*. In the present exemplary embodiment, the counterpart stop 26*l* is preferably provided in a way that allows it to be adjusted by means of a plurality of threaded holes 90*l*; naturally, it would also be conceivable to provide a fixed placement of the counterpart stop. The stop 24*l* cooperating with the counterpart stop 26*l* is provided on an inside 42*l* of the clamping band 28*l*, preferably in the form of a punched-out and reshaped hook. The stop according to FIG. 16 can naturally also be provided as a separate part 24*l*' on the clamping band 281'. The advantages of this variant, for example, would be a more solid design of the stop or production-related advantages. By means of a permanent deformation after a burst-wheel incident, the stop could be used as a mechanical "indicator". This indicating function could be used to verify the occurrence of the burst-wheel incident. FIG. 17 shows an alternative counterpart stop 26*l*', which is situated on the end surface 88*l*' of the flange neck 12*l*' and is integrated into the flange neck 12*l*'.

Figure 18:
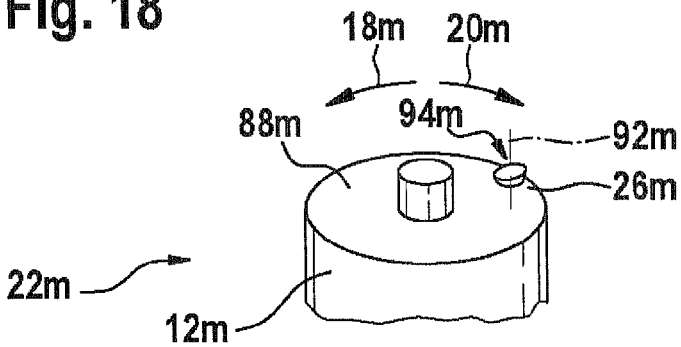
FIG. 18 shows a thirteenth embodiment of a locking device in which the counterpart stop is supported on the end surface of the flange neck in a spring-loaded fashion in a direction of a longitudinal axis.

Stops could be embodied so that they prevent the protective device 16 from rotating in one rotation direction 18 or 20, while permitting the protective device 16 to click past the detent positions in the opposite direction 20 or 18. FIG. 18 shows a partially depicted thirteenth embodiment of a locking device 22*m*. In this variant, the stop 24*m* is supported on the end surface 88*m* of the flange neck 12*m* in a spring-loaded fashion in a direction of a longitudinal axis 92*m*. In addition, it has a bevel 94*m* extending in the rotation direction 18*m* or 20*m*. In a burst-wheel incident, the counterpart stop 26*m* affixed to the protective device can travel in one rotation direction 18*m* or 20*m* past the spring-mounted counterpart stop 26*m* provided with the bevel 94*m* in that the counterpart stop 26*m* is slid back in the longitudinal direction 92*m*, whereas in the opposite direction 20*m* or 18*m*, the protective device 16*m* is abruptly stopped.

In the exemplary embodiments below, the stop 24 is embodied in the form of at least one lug that engages in a groove embodied as the counterpart stop 26; the lug 24 is provided on an inside 42 and/or on an end surface 44 of a clamping band 28 of the protective device 16 and the groove 26 is embodied in the form of a recess, which is provided in an outer circumference of the flange neck 12 and/or in the transmission flange 30 and is delimited in the circumference direction 18, 20. The delimitation 48 of the groove 26 is embodied in the form of an element inserted into the groove 26, a tab provided on the disk element 34, or a protuberance provided on the plate element 34.

Figure 19:
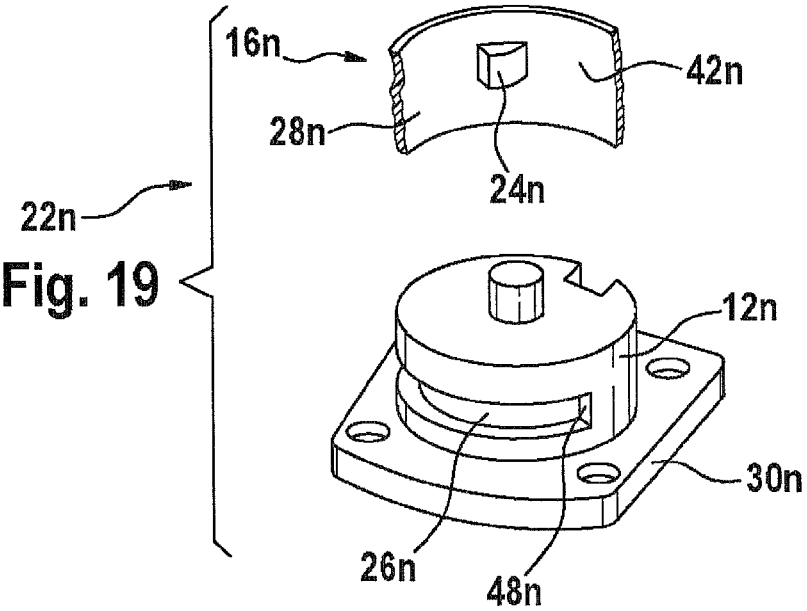
FIG. 19 shows a fourteenth embodiment of a locking device in which a lug embodied in the form of the stop engages in a groove embodied in the form of the counterpart stop and the groove has delimitations in the circumference direction.
Figure 20:
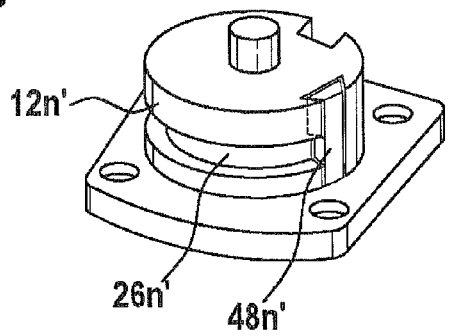
FIG. 20 shows a variant of a delimitation according to FIG. 18.
Figure 21:
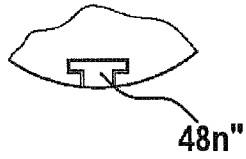
FIG. 21 shows another variant of a delimitation according to FIG. 18.

FIG. 19 shows a fourteenth embodiment of a locking device 22*n*. In this variant, a groove serving as a counterpart stop 26*n* is provided in the flange neck 12*n* embodied in the form of a recess 26*n* that extends on an outer circumference of the flange neck 12*n* and is delimited in the circumference direction 18*n*, 20*n*. A stop 24*n* embodied in the form of a lug and situated on an inside 42*n* of the clamping band 28*n* engages in this groove 26*n*. In a burst-wheel incident, this groove delimitation 48*n* causes the lug 24*n* to experience an impact situation, i.e. the protective device 16*n* is prevented from rotating. FIGS. 20 through 21 show alternative delimitations 48*n*', 48*n*" of an annular groove 26*n*' extending around the flange neck 12*n*'. In FIG. 20, the break in the annular groove is achieved by inserting a delimiting element 48*n*' into a recess in the flange neck 12*n*'. FIG. 21 shows an alternative embodiment of a delimiting element 48*n*". In order to vary the stop position, it is also possible for a plurality of delimiting elements to be provided on the circumference of the flange neck.

Figure 22:
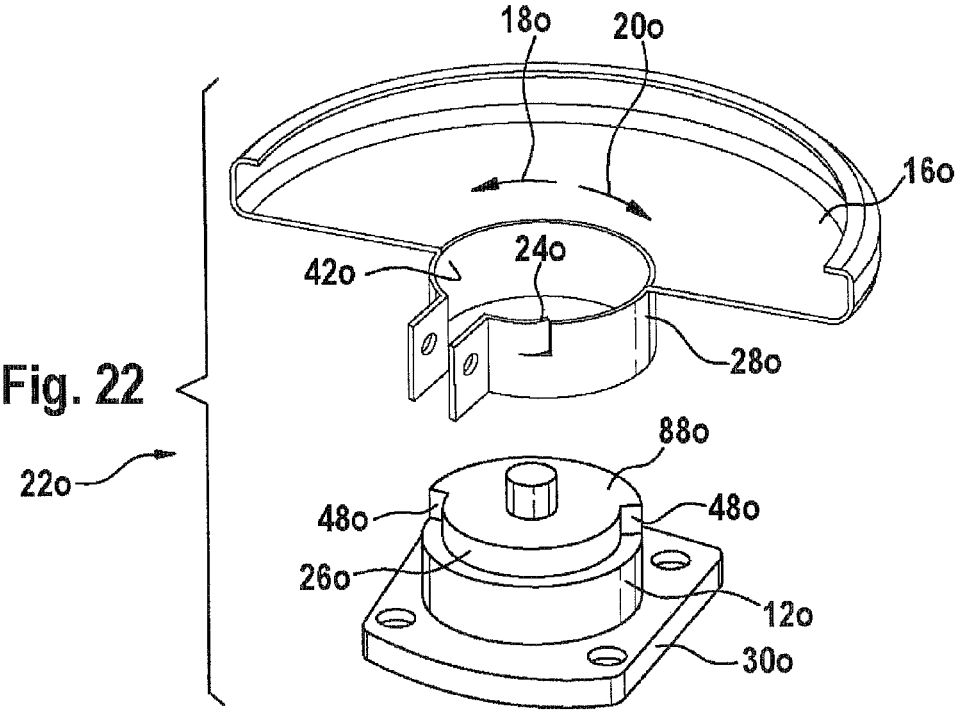
FIG. 22 shows a fifteenth embodiment of a locking device in which a groove extends in an edge region of the flange neck.

FIG. 22 shows a fifteenth embodiment of a locking device 22*o*. In this variant, the flange neck 12*o* is provided with a groove serving as a counterpart stop 26*o*, which is embodied in the form of a recess 26*o* that extends along the outer circumference in an edge region of the flange neck 12*o* and is delimited in the circumference direction; the recess 22*o* is open not only to the outside, but also toward the top. A stop 24*o* embodied in the form of a projection situated on an inside 42*o* of the clamping band 28*o* engages in this groove 26*o*; in a burst-wheel incident, the discontinuous groove 26*o* constitutes a rotation stop by means of the delimitations 48*o*.

Figure 23:
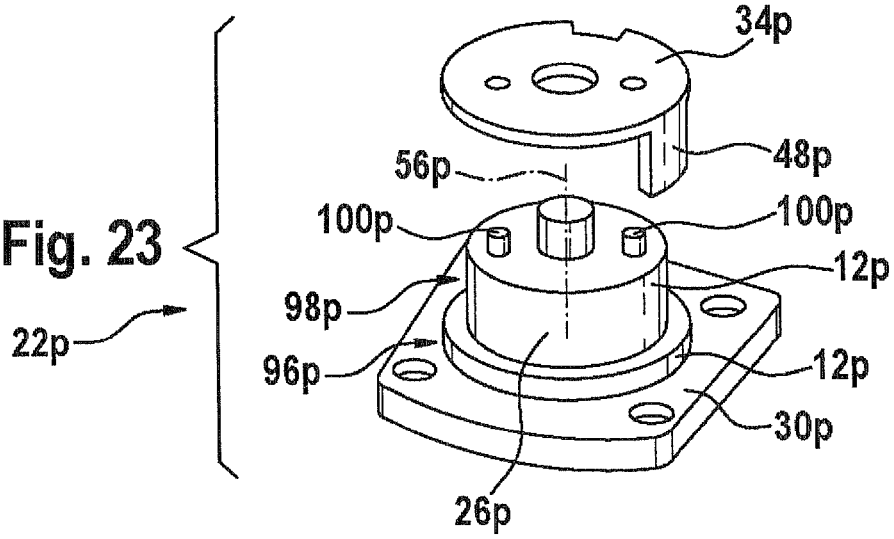
FIG. 23 shows a sixteenth embodiment of a locking device in which the groove is formed by the flange neck and a disk element that is placed onto the flange neck.

FIG. 23 shows part of a sixteenth embodiment of a locking device 22*p*. In this variant, the groove 26*p* is formed by the flange neck 12*p* and a disk element 34*p* that is placed onto the flange neck 12*p* in that the flange neck 12*p* has a lower region 96*p* with a larger diameter and an upper region 98*p* with a smaller diameter and the disk element 34*p* placed onto the flange neck 12*p* has a larger diameter than the upper region 98*p* of the flange neck 12*p*. The delimitation of the groove 26*p* is embodied in the form of a tab 48*p*, which is provided on the disk element 34*p* and extends toward the lower region 96*p* of the flange neck 12*p*. In the present exemplary embodiment, the disk element 34*p* is connected to the flange neck 12*p* by means of two riveted bolts 100*p*; it is also conceivable to use other types of fastener. If a plurality of riveted bolt holes arranged concentric to the axis 56*p* of the output shaft is provided, then the disk element 34*p* can be slid onto the flange neck 12*p* in various positions, permitting the manufacturer to shift the stop position "forward" or "back".

Figure 24:
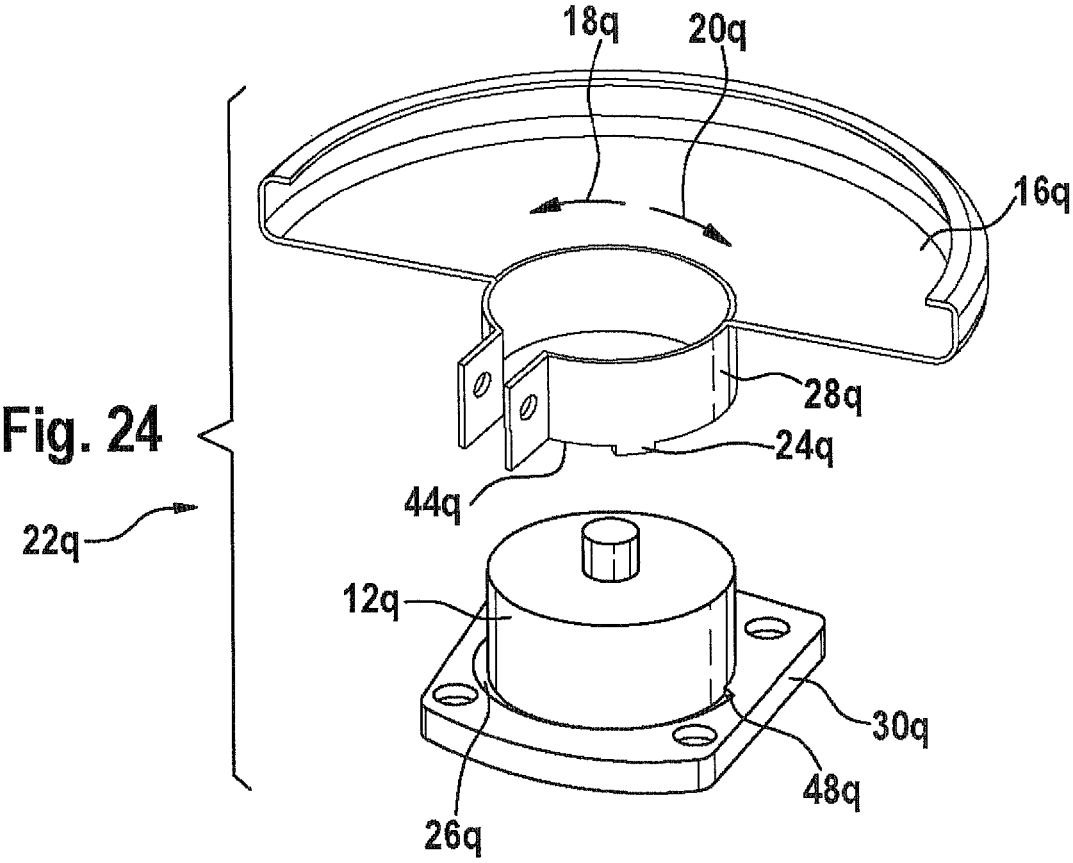
FIG. 24 shows a seventeenth embodiment of a locking device in which the groove extends in the transmission flange.

FIG. 24 shows a seventeenth embodiment of a locking device 22*q*. In this variant, the groove serving as the counterpart stop 26*q* is embodied in the form of a recess 26*q* extending in the transmission flange 30*q* and delimited in the circumference direction 18*q*, 20*q*, in which a lug 24*q* engages, which is embodied in the form of a stop and is situated on an end surface 44*q* of the clamping band 28*q* of the protective device 16*q*. The groove 26*q* in the housing is then delimited at a suitable location so that in a burst-wheel incident, the lug 24*q* affixed to the protective device strikes against the delimitation 48*q* and stops the rotation.

Figure 25:
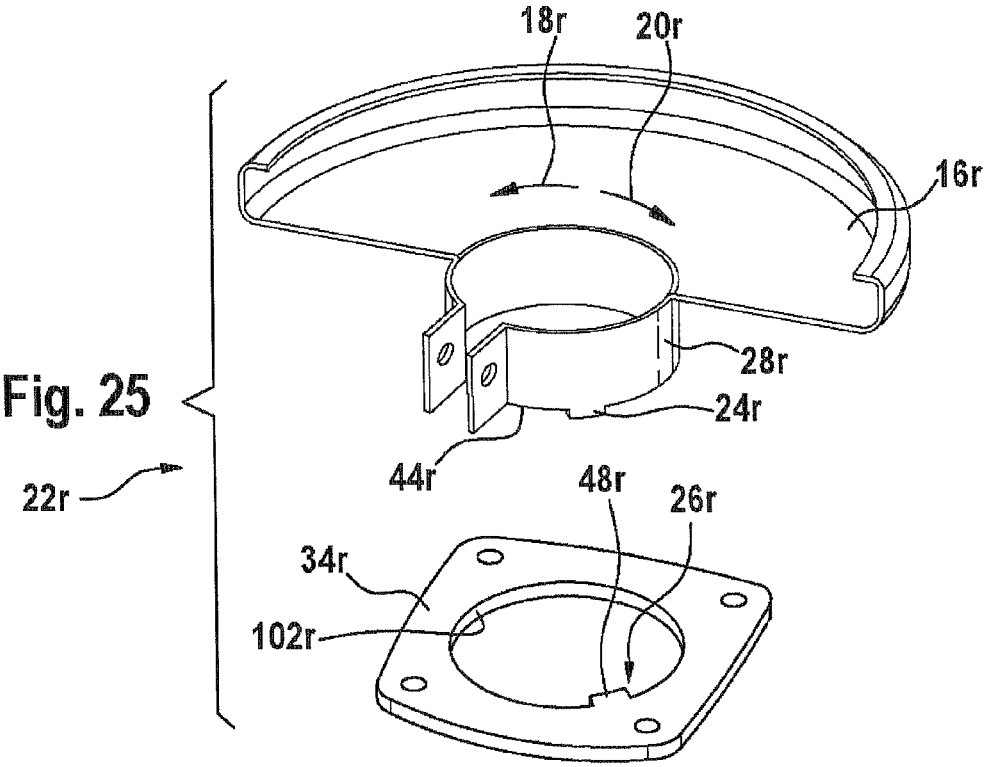
FIG. 25 shows an eighteenth embodiment of a locking device in which the groove is formed by the flange neck and a plate element that is slid onto the flange neck and fastened to the transmission flange.

FIG. 25 shows an eighteenth embodiment of a locking device 22*r*. In this variant, the groove serving as a counterpart stop 26*r* is provided on a housing element 34*r* embodied in the form of a plate element 34*r* provided on the transmission flange, which is not shown here. The flange neck, not shown here, and the plate element 34*r*, which is slid onto the flange neck and fastened to the transmission flange, form the groove 26*r* in that the plate element 34*r* is equipped with an opening 102 whose diameter is greater than the diameter of the flange neck. This forms the groove 26*r*, which is situated between the flange neck and plate element 34*r* and is delimited in the circumference direction by a protuberance 48*r* provided on the plate element 34. This variant is particularly well-suited for retrofitting a hand-held power tool.

Figure 26:
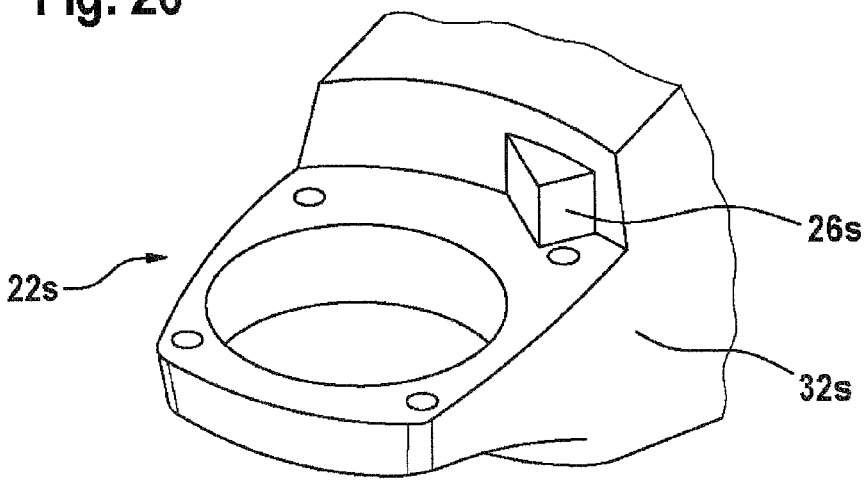
FIG. 26 shows a nineteenth embodiment of a locking device in which the stop is situated on the transmission housing.

FIG. 26 shows part of a nineteenth embodiment of a locking device 22*s*. In this variant, the counterpart stop 26*s* is situated on the transmission housing 32*s*. Preferably, the counterpart stop 26*s* is integrated into the transmission housing 32*s*. The counterpart stop can, however, also be mounted to the transmission housing as a separate component.

Figure 27A:
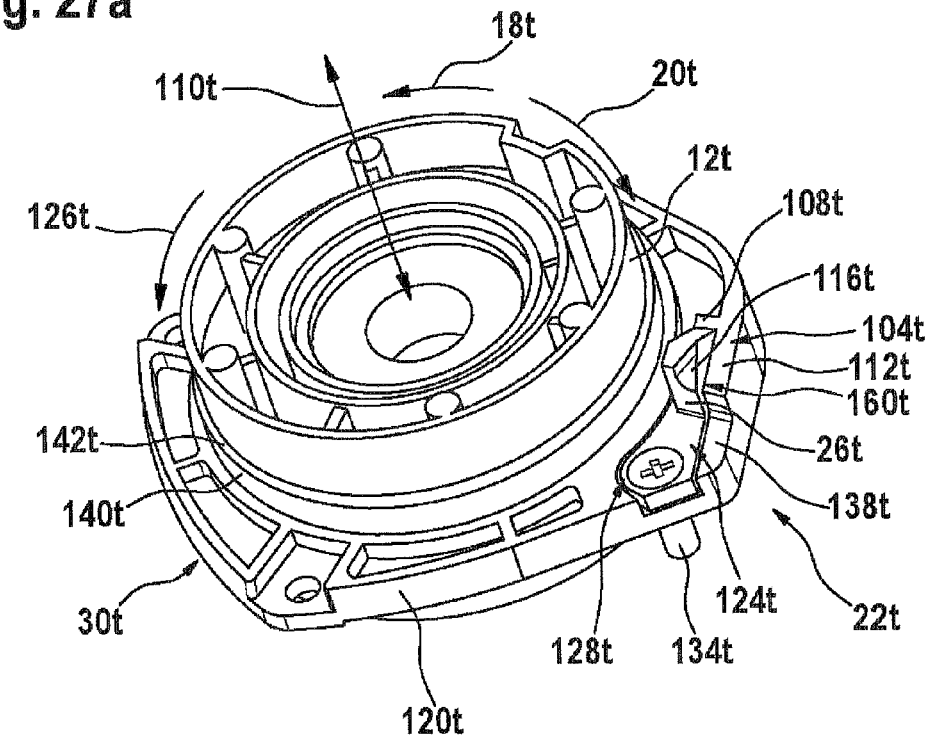
FIGS. 27*a* and 27*b* show a first perspective depiction (FIG. 27*a*) and a second perspective depiction (FIG. 27*b*) of a twentieth embodiment of a locking device in which a counterpart stop is situated on the transmission flange.
Figure 27B:
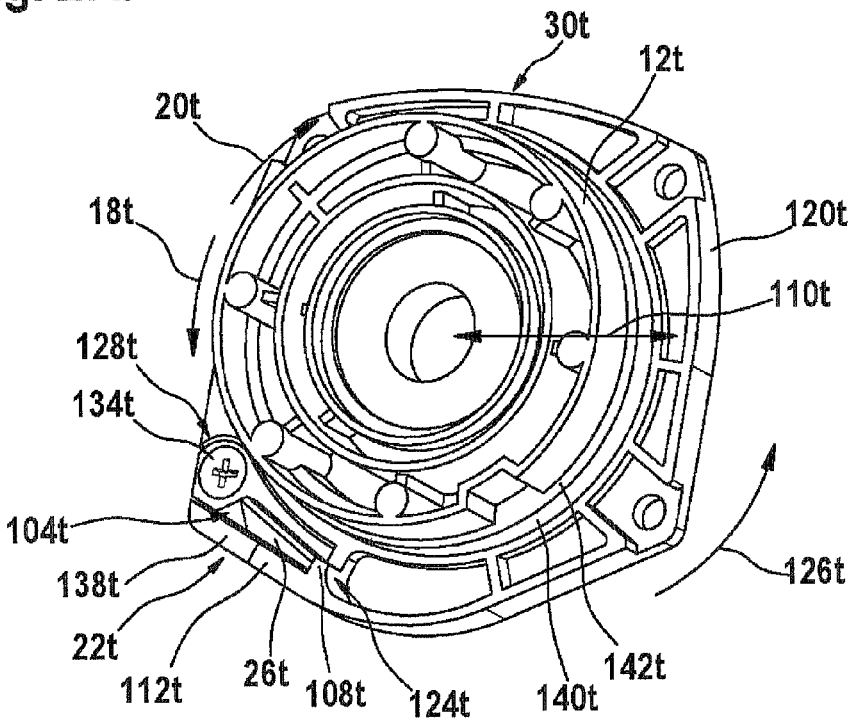
Figure 28A:
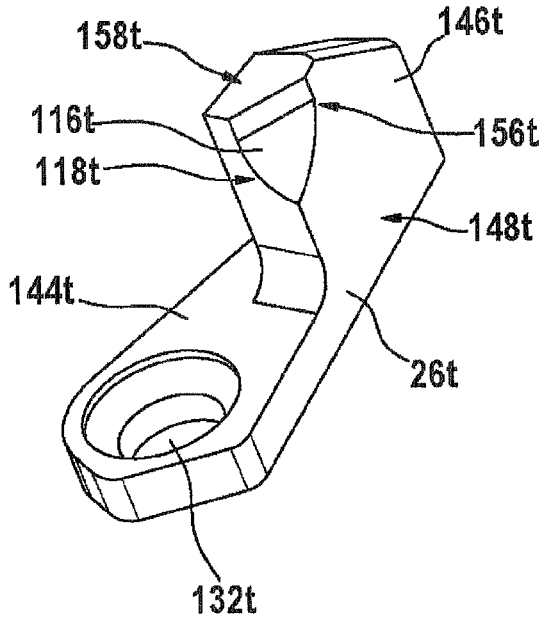
FIGS. 28*a* and 28*b* show a first perspective depiction (FIG. 28*a*) and a second perspective depiction (FIG. 28*b*) of the counterpart stop from FIGS. 27*a* and 27*b*, FIGS. 29*a* and 29*b* show a first perspective depiction (FIG. 29*a*) and a second perspective depiction (FIG. 29*b*) of a subregion of the transmission flange from FIGS. 27*a* and 27*b*, and FIGS. 30*a* and 30*b* show the locking device from FIGS. 27*a* and 27*b*, with a mounted protective device.
Figure 28B:
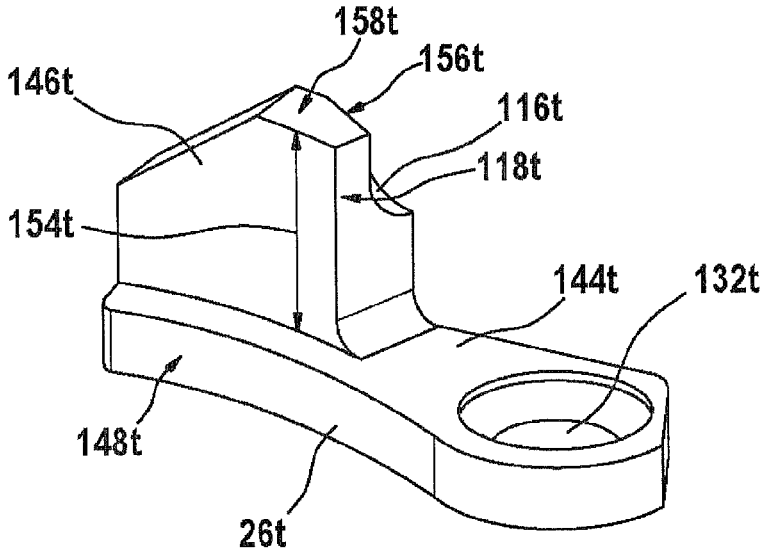
Figure 29A:
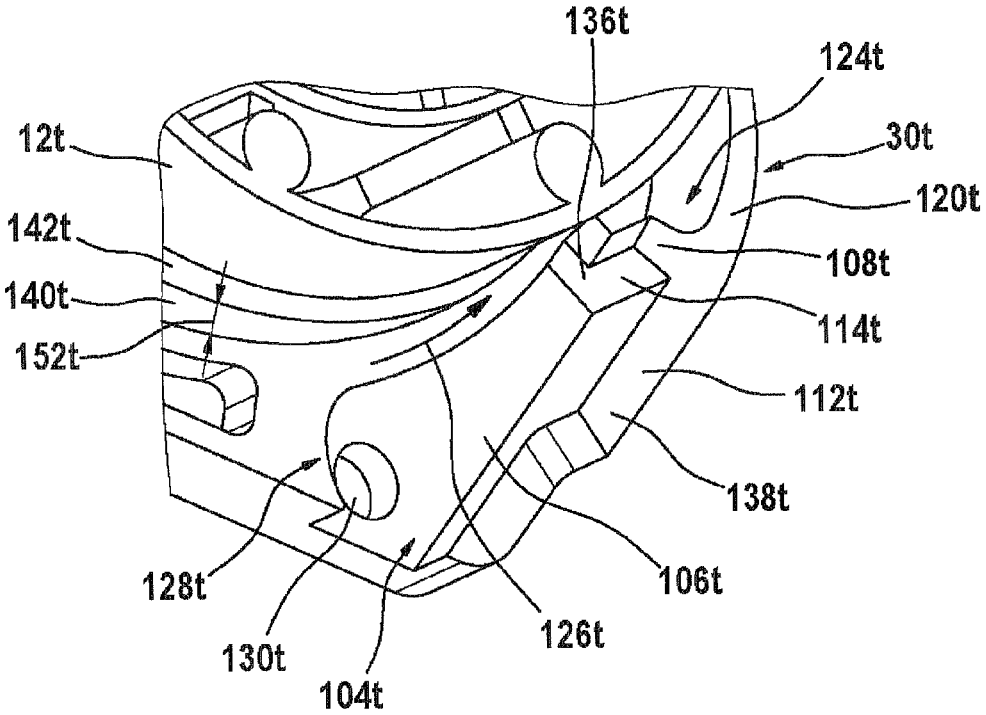
Figure 29B:
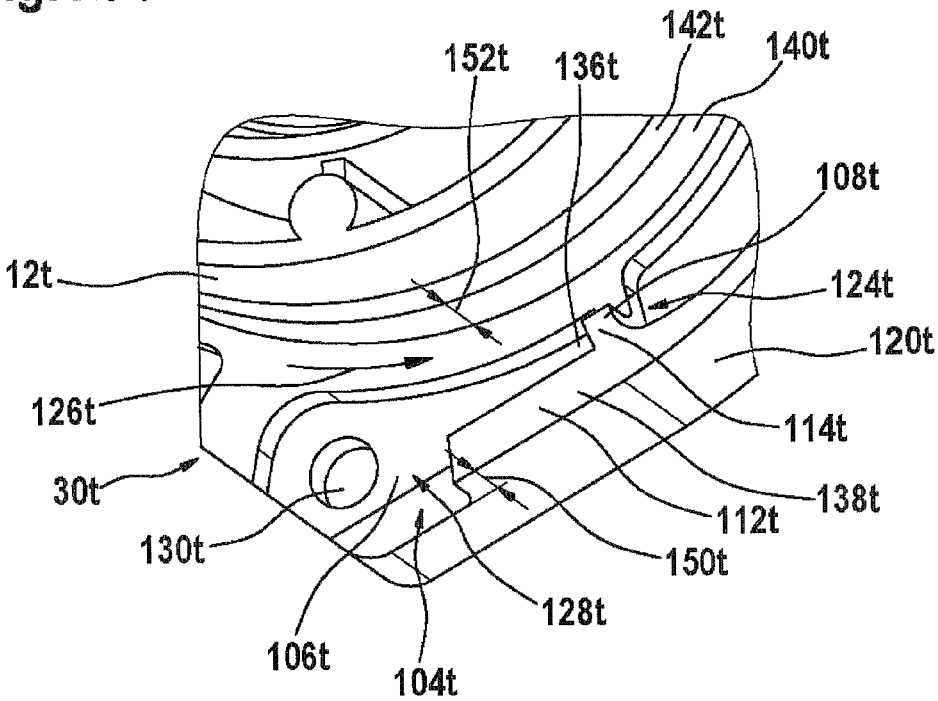

FIGS. 27*a* and 27*b* show part of a locking device 22*t* in an embodiment that differs from the ones in FIGS. 2 through 26. A counterpart stop 26*t* of the locking device 22*t* is situated on a transmission flange 30*t* of a hand-held power tool. The counterpart stop 26*t* is embodied in the form of a separate component from the transmission flange 30*t* and when installed, is screw-mounted to the transmission flange 30*t*. In addition, the locking device 22*t* has a receiving element 104*t* that is situated on the transmission flange 30*t* and is provided to accommodate the counterpart stop 26*t*. The receiving element 104*t* has a recess 106*t* on the transmission flange 30*t* (FIGS. 29*a* and 29*b*). The recess 106*t* and the receiving element 104*t* are situated on a base body 120*t* of the transmission flange 30*t*; the base body 120*t* extends outward in a radial direction 110*t* from a flange neck 12*t* and essentially perpendicular to both the flange neck 12*t* and an axis 56 of an output shaft 52. The recess 106*t* is situated in an outer edge region 124*t* of the base body 120*t* in the radial direction 110*t* and extends in a rotation direction 18*t*, 20*t* along a subregion of the flange neck 12*t* (see FIGS. 27*a*, 27*b*, 29*a*, and 29*b*). The recess 106*t* is also embodied as tapering in one turning direction 126*t* of a tool embodied in the form of a grinding wheel 54.

Figure 30A:
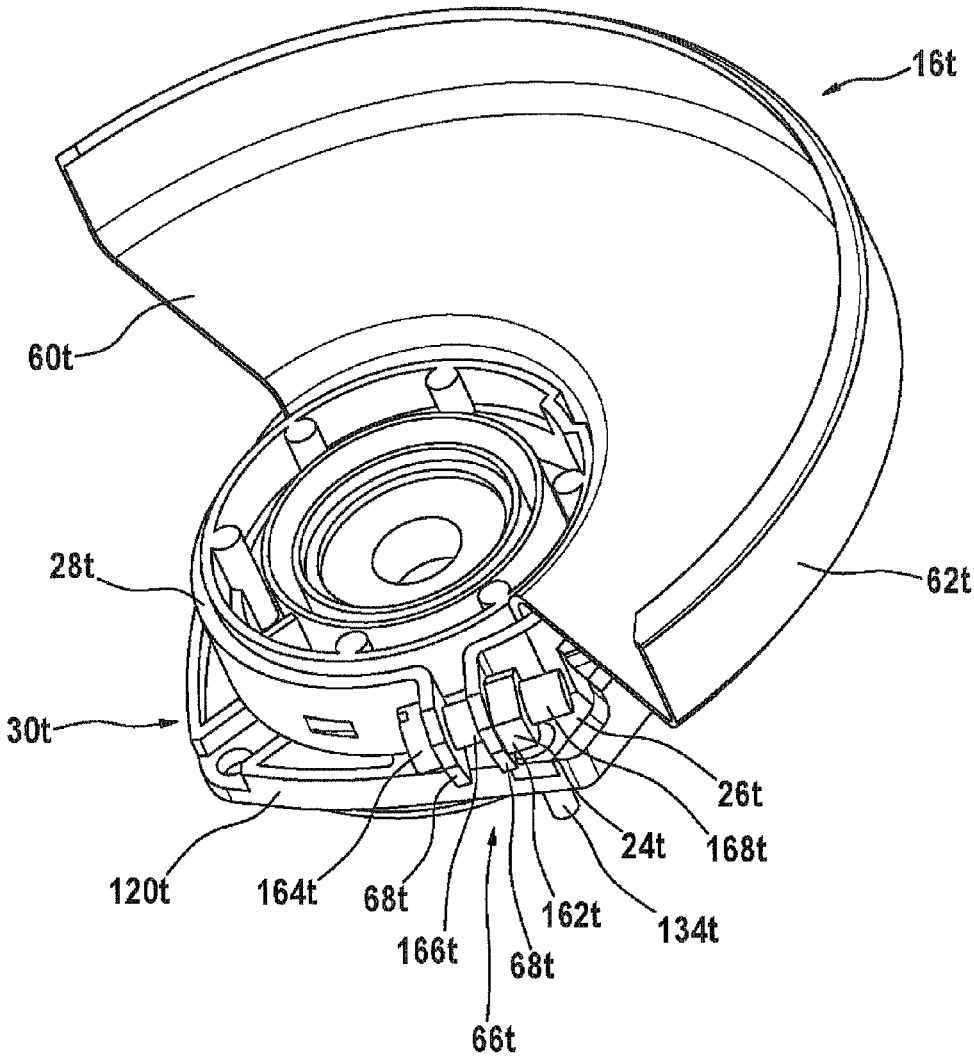
Figure 30B:
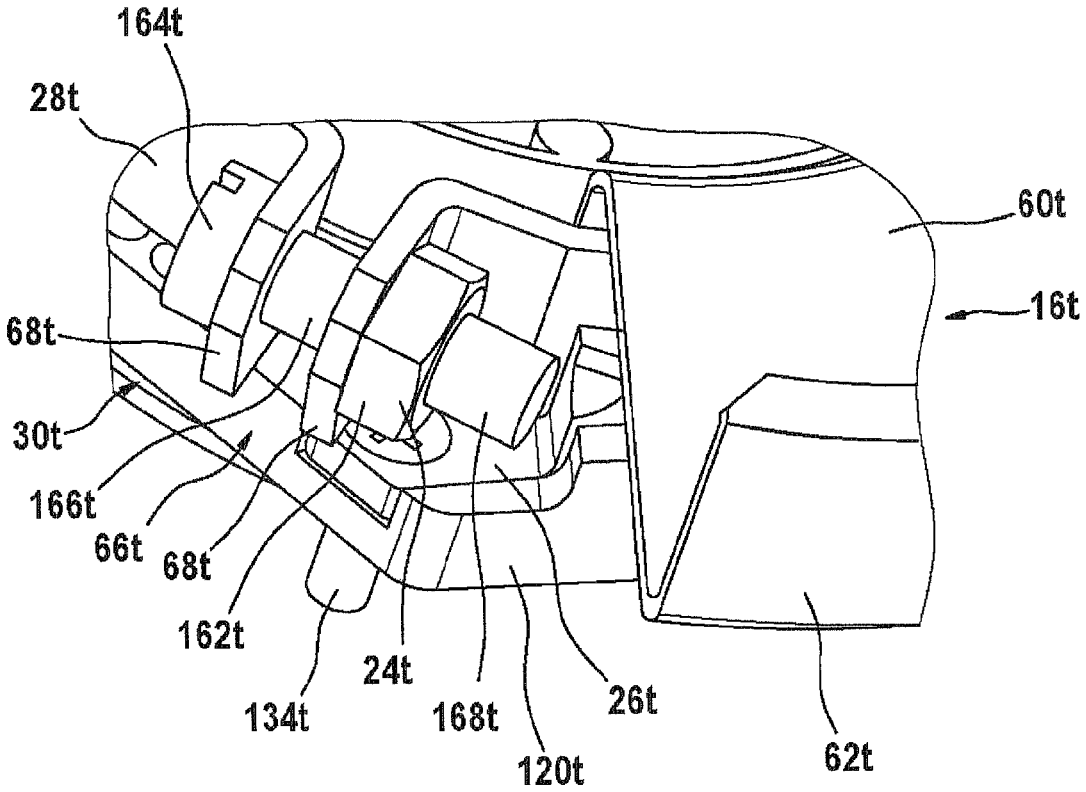

The recess 106*t* is situated in the region 128*t* of a fastening recess 130*t* for the fastening of the transmission flange 30*t* to a transmission housing 32 of the hand-held power tool so that when the counterpart stop 26*t* is fastened to the transmission flange 30*t*, it is simultaneously fastened to the transmission housing 32. For this purpose, the counterpart stop 26*t* is also equipped with an opening 132*t* (FIGS. 28*a* and 28*b*) through which a fastening screw 134*t* reaches in an installed position and is screwed to the transmission housing 32 (FIGS. 27*a* and 27*b*). The fastening screw 134*t* is embodied in the form of a countersunk head screw so that when the protective device 16*t* rotates together with the stop 24*t* due to the transmission of an impulse from a tool part of a burst tool that is hurled outward, the stop 24*t* can come into contact with the counterpart stop 26*t* with no hindrance (FIGS. 30*a* and 30*b*). The receiving element 104*t* also has two support elements 108*t*, 112*t* that are provided to support the counterpart stop 26*t* in the event of a burst tool (FIGS. 27*a*, 27*b*, 29*a*, and 29*b*). One of the two support elements 108*t* is provided to support the counterpart stop 26*t* in the rotation direction 18*t* and the turning direction 126*t* of the tool and for this purpose, the recess 106*t* is situated at an end 136*t*, which is tapered in the rotation direction 18*t* and the turning direction 126*t*, and is embodied in the form of a rib 114*t* extending in the radial direction 110*t*. The additional support element 112*t* is provided to support the counterpart stop 26*t* in a radial direction 110*t*. For this purpose, the support element 112*t* is embodied in the form of a wall that extends along the rotation direction 18*t*, 20*t* and the turning direction 126*t* on an outer edge 138*t* of the base body 120*t* encompassing the recess 106*t* in the radial direction 110*t*. The two support elements 108*t*, 112*t* are embodied as integral to each other and are also embodied as integral to the base body 120*t* and transmission flange 30*t* (FIGS. 27*a*, 27*b*, 29*a*, and 29*b*). The support element 112*t* for supporting the counterpart stop 26*t* in the radial direction 110*t* has a height 150*t* along the axis 56 of the output shaft 52 that is at most exactly as high as a height 152*t* of a subregion 140*t* of the flange neck 12*t* oriented toward the base body 120*t*. The subregion 140*t* of the flange neck 12*t* oriented toward the base body 120*t* is delimited along the axis 56 by a groove 142*t*, which extends around the flange neck 12*t* in the rotation direction 18*t*, 20*t* and is provided for guiding a coding element, not shown in detail, of the protective device; the groove 142*t* can be provided by means of a subsequent machining of the transmission flange 30*t*, e.g. by means of a turning procedure.

The counterpart stop 26*t* has a base body 144*t*, which has a tapered shape of the recess 106*t* and is situated in the recess in an installed position, and has a stop element 146*t* (see FIGS. 27*a* through 28*b*). The stop element 146*t* is situated in a tapered region 148*t* of the base body 144*t*. The stop element 146*t* also has a height 154*t* that is higher than a height 150*t* of the support element 112*t* so that the stop 24*t* can come into contact with the stop element 146*t* of the counterpart stop 26*t*. The stop 24*t* is composed of a fastening element 162*t*—embodied in the form of a nut—of the clamping device 66*t*; the nut is screwed together with a fastening element embodied in the form of a clamping screw 164*t* in an installed position of protective device 16*t*. Because of the low height 150*t* of the support element 112*t*, a clamping screw end 168*t* of the clamping screw 164*t* oriented toward the counterpart stop 26*t* can be guided past the counterpart stop 26*t* so that only the clamping device 26*t* stop 24*t* constituted by the nut comes into contact with or strikes the counterpart stop 26*t* in the event that the protective device 16*t* undesirably rotates in the turning direction 126*t* of the tool because a tool part of a burst tool has been hurled outward and collided with the protective device 16*t* (see FIGS. 30*a* and 30*b*). When assembled with the transmission flange 30*t*, the stop element 146*t* of the counterpart stop 26*t* additionally rests against the support element 112*t* in the radial direction 110*t* toward the outside and rests against the support element 108*t* in the rotation direction 18*t* and the turning direction 126*t* so that in the event that the stop 53 of the protective device 16 strikes against the counterpart stop 26*t* because of a burst tool, this counterpart stop 26*t* is supported against the transmission flange 30*t* via the receiving element 104*t* and forces that are transmitted to the counterpart stop 26*t* can be conveyed away via the transmission flange 30*t*. In order to achieve an advantageous absorption of energy in the event that the stop 24 strikes against the counterpart stop 26*t* because of a burst tool, the counterpart stop 26*t* is composed of a material that differs from the material of the transmission flange 30*t*, e.g. an energy-absorbing material. It is also conceivable for the counterpart stop 26*t* and the transmission flange 30*t* to be integral to each other, namely embodied in the form of a single component, and/or for the counterpart stop 26*t* and the transmission flange 30*t* to be composed or manufactured of the same material.

The stop element 146*t* of the counterpart stop 26*t* also has an indentation 116*t* that is situated in an impact region 118*t* of an impact between the stop 24*t* and the counterpart stop 26*t* (FIGS. 28*a*, 28*b*, 30*a*, and 30*b*). The indentation 116*t* is situated in an outer edge region 156*t* of the stop element 146*t* in the radial direction 110*t* and when the counterpart stop 26*t* is mounted to the transmission flange 30*t*, extends from an end region 158*t* remote from the base body 144*t* to an end region 160*t* of the support element 112*t* remote from the base body 144*t*. As a result, when the stop 24*t* and the counterpart stop 26*t* strike each other due to an undesired rotation of the protective device 16*t* because a tool part of a burst tool has been hurled outward and collided with the protective device 16*t*, the clamping screw end 168*t* of the clamping screw 164*t* oriented toward the counterpart stop 26*t* is guided past the counterpart stop 26*t*, in particular past the impact region 118*t* of the counterpart stop 26*t*, and only the stop 24*t* constituted by the nut strikes the impact region 118*t*. It is basically also conceivable for an end of a clamping band 28*t* of the protective device 16*t* to constitute the stop 24*t* and/or for it to be constituted by other components of the protective device 16*t* deemed suitable by the person skilled in the art.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool comprising:

a housing equipped with a flange neck;

a clamping band having a first fastening flange at a first end thereof and a second fastening flange at a second opposite end thereof;

a fastener configured to secure the first fastening flange with respect to the second fastening flange;

a protective device that is attached to the flange neck, the protective device being rotatable in a circumference direction, wherein said first fastening flange, said second fastening flange, and said fastener are advanced in a path of movement in response to rotation of said protective device; and a stop structure positioned in said path of movement so that physical interaction between said stop structure and at least one of one of said first fastening flange, said second fastening flange, and said fastener limits rotation of said protective device.

2. The hand-held power tool as recited in claim 1, wherein the stop structure is configured such that in emergency operation of the hand-held power tool, the protective device is only permitted to rotate in at least one rotation direction until the protective device reaches a predetermined rotation position at which the stop structure and the at least one of the first fastening flange, the second fastening flange, and the fastener physically interact.

3. The hand-held power tool as recited in claim 1, wherein the stop structure and the at least one of the first fastening flange, the second fastening flange, and the fastener prevent the protective device from rotating in one rotation direction and permit the protective device to rotate in an opposite rotation direction.

4. The hand-held power tool as recited in claim 1, wherein the stop structure is provided on a transmission flange, on the flange neck, on a transmission housing, and/or on a housing element.

5. The hand-held power tool as recited in claim 4, wherein the stop structure is of one piece with the transmission flange, the flange neck, the transmission housing, and/or the housing element.

6. The hand-held power tool as recited in claim 4, wherein the housing element is embodied as an element provided on or under the transmission flange or as an element that has the capacity to be accommodated on the flange neck.

7. The hand-held power tool as recited in claim 1, wherein the stop structure is situated on a transmission flange in a screw-mountable fashion.

8. The hand-held power tool as recited in claim 1, wherein the stop structure is composed of a material that differs from a material of a transmission flange.

9. The hand-held power tool as recited in claim 1, wherein the stop structure has an indentation that is situated in region where the stop structure and the at least one of the first fastening flange, the second fastening flange, and the fastener physically interact.

10. A hand-held power tool, comprising:

a housing equipped with a flange neck;

a protective device that is accommodated on the flange neck and is configured to rotate in the circumference direction; and at least one locking device for preventing the protective device from rotating in at least one rotation direction, the locking device including at least one stop and at least one counterpart stop that cooperates with the stop, wherein the counterpart stop is provided on a transmission flange, on the flange neck, on a transmission housing, and/or on a housing element, and wherein the protective device includes at least two locations for the stop to be adjustably positioned and/or one of the housing and the housing element includes at least two locations for the counterpart stop to be adjustably situated.

11. A hand-held power tool, comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop and at least one counterpart stop that cooperates with the stop, wherein the counterpart stop is provided on a housing element, and wherein the housing element is adjustably connected to the housing by a connection.

12. The hand-held power tool as recited in claim 11, wherein the connection is produced by means of projections of the housing element and/or housing, which are insertable into recesses of the housing and/or housing element.

13. A hand-held power tool comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop, at least one counterpart stop that cooperates with the stop, wherein the locking device has at least one damping device.

14. The hand-held power tool as recited in claim 13, wherein the stop is affixed to the protective device and the counterpart stop is affixed to the housing of the hand-held power tool.

15. The hand-held power tool as recited in claim 13, wherein the stop is provided on a clamping band of the protective device.

16. The hand-held power tool as recited in claim 13, wherein the stop is at least partially composed of a fastening element of the protective device.

17. The hand-held power tool as recited in claim 13, wherein the stop and/or the counterpart stop is equipped with the damping device and/or embodied as the damping device.

18. The hand-held power tool as recited in claim 13, wherein the stop is embodied in the form of at least one lug that engages in a groove embodied in the form of a counterpart stop.

19. The hand-held power tool as recited in claim 18, wherein the lug is provided on an inside and/or on an end surface of the clamping band of the protective device.

20. The hand-held power tool as recited in claim 18, wherein the groove is embodied in the form of a recess, which extends along an outer circumference of the flange neck and/or in a transmission flange and is delimited in the circumference direction.

21. The hand-held power tool as recited in claim 13, wherein the counterpart stop is affixed to the housing and additionally serves as a hold-down element for the protective device.

22. The hand-held power tool as recited in claim 13, wherein the locking device has at least one receiving element, which is situated on a transmission flange and is provided to accommodate the counterpart stop.

23. A hand-held power tool comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop and at least one counterpart stop that cooperates with the stop, wherein the stop is embodied in the form of at least one lug that engages in a groove embodied in the form of the counterpart stop and the groove is formed by the flange neck and a disk element that is slid onto the flange neck.

24. A hand-held power tool comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop and at least one counterpart stop that cooperates with the stop, wherein the stop is embodied in the form of at least one lug that engages in a groove embodied in the form of the counterpart stop and the groove is embodied in the form of a recess, which extends along an outer circumference of a transmission flange and is delimited in the circumference direction, and the groove is formed by the transmission flange and a plate element that is placed onto the transmission flange.

25. A hand-held power tool comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop and at least one counterpart stop that cooperates with the stop, wherein the stop is embodied in the form of at least one lug that engages in a groove embodied in the form of the counterpart stop and the groove is embodied in the form of a recess, which extends along an outer circumference of a transmission flange and/or in a transmission flange and is delimited in the circumference direction, and wherein delimitation of the groove is embodied in the form of an element inserted into the groove, a tab provided on a disk element, or a protuberance provided on a plate element.

26. A hand-held power tool comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop and at least one counterpart stop that cooperates with the stop, wherein the locking device has at least one receiving element, which is situated on a transmission flange and is provided to accommodate the counterpart stop, and the receiving element has at least one recess on the transmission flange, which is provided to accommodate the counterpart stop.

27. A hand-held power tool comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop and at least one counterpart stop that cooperates with the stop, wherein the locking device has at least one receiving element, which is situated on a transmission flange and is provided to accommodate the counterpart stop, and wherein the receiving element has at least one support element that supports the counterpart stop in at least one rotation direction.

28. The hand-held power tool as recited in claim 27, wherein the support element is composed of a rib extending in the radial direction.

29. The hand-held power tool as recited in claim 27, wherein the support element for supporting the counterpart stop in at least one rotation direction is embodied as integral to a transmission flange.

30. A hand-held power tool comprising:

a housing equipped with a flange neck, a protective device that has the capacity to be accommodated on the flange neck and rotated in the circumference direction, and at least one locking device for preventing the protective device from rotating in at least one rotation direction, the locking device including at least one stop and at least one counterpart stop that cooperates with the stop, wherein the locking device has at least one receiving element, which is situated on a transmission flange and is provided to accommodate the counterpart stop, and wherein the receiving element has at least one support element that supports the counterpart stop in at least one radial direction.

31. The hand-held power tool as recited in claim 30, wherein the support element for supporting the counterpart stop in the radial direction is embodied as integral to a transmission flange.

* * * * *

UNITED STATES PATENT AND TRADEMARK OFFICE

CERTIFICATE OF CORRECTION

PATENT NO. : 8,500,521 B2
APPLICATION NO. : 12/745060
DATED : August 6, 2013
INVENTOR(S) : Boeck et al.

It is certified that error appears in the above-identified patent and that said Letters Patent is hereby corrected as shown below:

In the claims:

Claim 16, line 1 (col. 17, line 35):

Replace "as recited in claim 13" with -- as recited in claim 15 --

Signed and Sealed this
First Day of April, 2014

Michelle K. Lee

Michelle K. Lee
*Deputy Director of the United States Patent and Trademark Office*